US010425728B2

(12) United States Patent
Tanaka

(10) Patent No.: US 10,425,728 B2
(45) Date of Patent: Sep. 24, 2019

(54) ACOUSTIC PROCESSING APPARATUS, ACOUSTIC PROCESSING SYSTEM, ACOUSTIC PROCESSING METHOD, AND STORAGE MEDIUM

(71) Applicant: CANON KABUSHIKI KAISHA, Tokyo (JP)

(72) Inventor: Katsumasa Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/108,778

(22) Filed: Aug. 22, 2018

(65) Prior Publication Data

US 2019/0069085 A1 Feb. 28, 2019

(30) Foreign Application Priority Data

Aug. 30, 2017 (JP) ..... 2017-166105

(51) Int. Cl.
*H04R 3/00* (2006.01)
*G10L 19/008* (2013.01)
*H04R 1/40* (2006.01)

(52) U.S. Cl.
CPC ..... *H04R 3/005* (2013.01); *G10L 19/008* (2013.01); *H04R 1/40* (2013.01)

(58) Field of Classification Search
USPC ..... 381/91, 92, 94.1, 97, 98, 102, 94.2, 122, 381/80
See application file for complete search history.

(56) References Cited

U.S. PATENT DOCUMENTS 8,731,212 B2 * 5/2014 Takahashi ..... H04R 3/005 381/122
9,497,542 B2 * 11/2016 Tanaka ..... H04R 3/00

FOREIGN PATENT DOCUMENTS

JP 2014-175996 A 9/2014

* cited by examiner

*Primary Examiner* — Yosef K Laekemariam
(74) *Attorney, Agent, or Firm* — Canon U.S.A., Inc., IP Division

(57) ABSTRACT

An acoustic processing apparatus includes a detection unit configured to detect a change in a state of a microphone, and a determination unit configured to determine a parameter to be used in acoustic signal generation by a generation unit configured to generate an acoustic signal based on one or more of a plurality of channels of sound collection signals acquired based on sound collection by a plurality of microphones, wherein in a case where a change in at least any of states of the plurality of microphones is detected by the detection unit, the determination unit determines the parameter based on the states of the plurality of microphones after the change.

20 Claims, 20 Drawing Sheets

ACOUSTIC PROCESSING APPARATUS, ACOUSTIC PROCESSING SYSTEM, ACOUSTIC PROCESSING METHOD, AND STORAGE MEDIUM

BACKGROUND OF THE INVENTION

Field of the Invention

The present invention relates to a technique for generating acoustic signals based on sounds collected by a plurality of microphones.

Description of the Related Art

There is a technique for generating acoustic signals (e.g., 22.2 channel surround) for multi-channel reproduction from sound collection signals of a plurality of channels which are based on sounds collected by a plurality of microphones installed in a sound collection target space such as an event venue. Specifically, the installation positions and characteristics of the plurality of microphones are recorded in advance, and the sound collection signals of the plurality of channels are combined using a combining parameter corresponding to the recorded content to generate acoustic signals to be reproduced by respective speakers in a multi-channel reproduction environment.

Japanese Patent Application Laid-Open No. 2014-175996 discusses a method of automatically estimating the positions and orientations of a plurality of microphones based on the directions from which the sounds arrive at the plurality of installed microphones and position information about sound sources.

According to the conventional technique, however, if there is a state change in the microphone, appropriate sounds may not be reproduced from the acoustic signals generated based on the sounds collected by the plurality of microphones.

For example, in a case in which there is a change in the positions of the installed microphones, if acoustic signals are generated by combining sound collection signals using a combining parameter corresponding to the position before the change, the direction in which sounds reproduced based on the acoustic signals are heard can be different from a desired direction.

SUMMARY OF THE INVENTION

According to an aspect of the present invention, an acoustic processing apparatus includes a detection unit configured to detect a change in a state of a microphone, and a determination unit configured to determine a parameter to be used in acoustic signal generation by a generation unit configured to generate an acoustic signal based on one or more of a plurality of channels of sound collection signals acquired based on sound collection by a plurality of microphones, wherein in a case where a change in at least any of states of the plurality of microphones is detected by the detection unit, the determination unit determines the parameter based on the states of the plurality of microphones after the change.

Further features will become apparent from the following description of exemplary embodiments with reference to the attached drawings.

DESCRIPTION OF THE EMBODIMENTS

Various exemplary embodiments will be described below with reference to the attached drawings.

[System Configuration]

Figure 1:
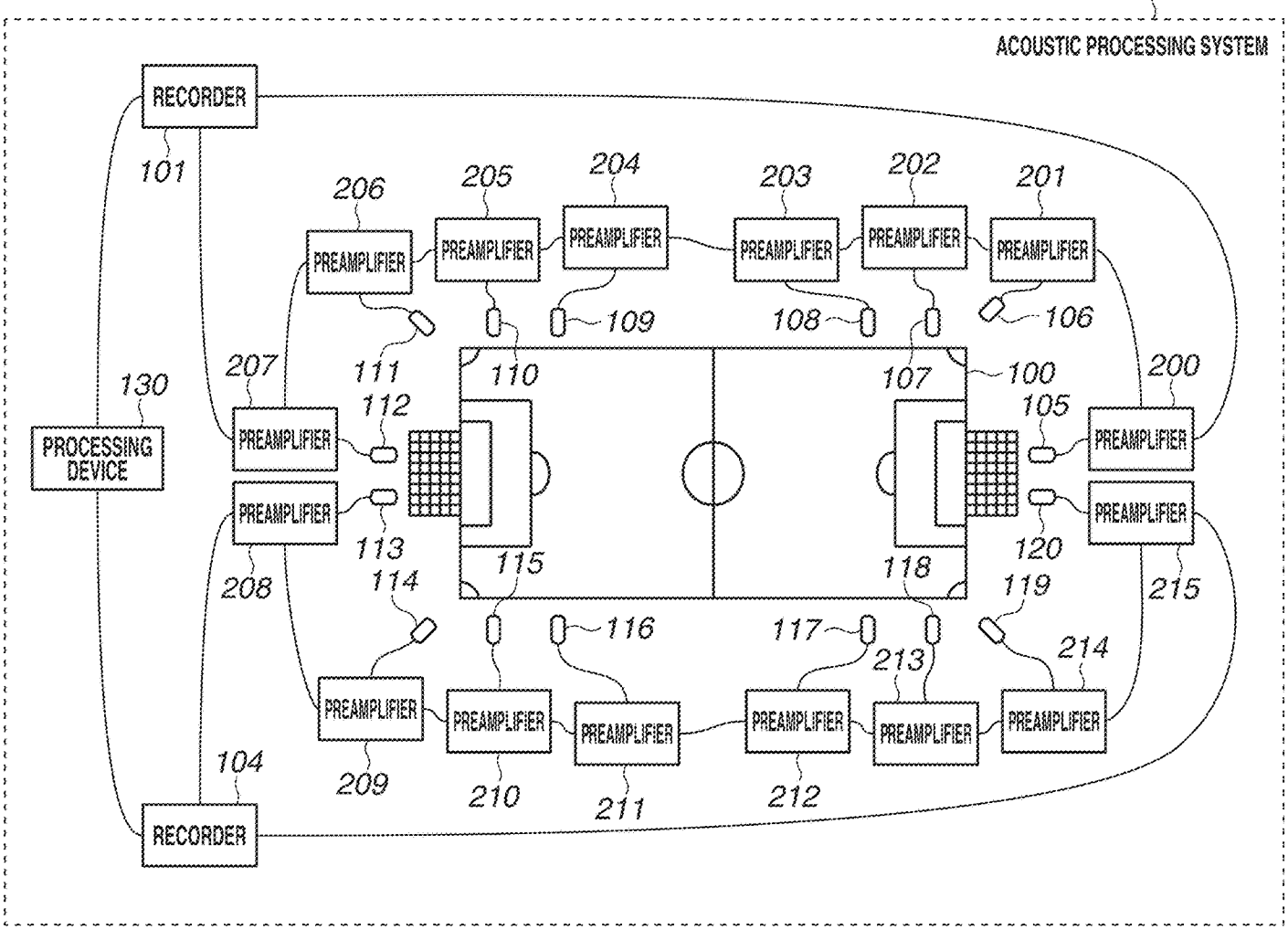
FIG. 1 schematically illustrates a configuration of an acoustic processing system.

A first exemplary embodiment will be described below. FIG. 1 schematically illustrates a configuration of an acoustic processing system 10. The acoustic processing system 10 includes recorders 101 and 104, microphones 105 to 120, preamplifiers 200 to 215, and a processing device 130. In the present exemplary embodiment, the plurality of microphones 105 to 120 will be referred to simply as "microphone" unless the microphones 105 to 120 need to be distinguished, and the plurality of preamplifiers 200 to 215 will be referred to simply as "preamplifier" unless the preamplifiers 200 to 215 need to be distinguished.

In the present exemplary embodiment, the plurality of microphones 105 to 120 is installed around a field 100 in an athletic field, which is a sound collection target space, to collect sounds of soccer games in the field 100 and sounds from an audience (stands). The plurality of microphones only needs to be installed such that sounds can be collected at a plurality of positions and does not have to be installed all over the field 100. Further, the sound collection target space is not limited to athletic fields and can be, for example, a stage of a performing venue.

The preamplifiers 200 to 215 are respectively connected to the microphones 105 to 120, and sound collection signals based on sounds collected by the respective microphones 105 to 120 are respectively output to the corresponding preamplifiers 200 to 215. Each of the preamplifiers 200 to 215 performs signal processing on sound collection signals based on sounds collected by the corresponding microphone among the microphones 105 to 120 and transmits the processed data to the recorder 101 or 104. Specific examples of signal processing performed by the preamplifiers 200 to 215 include limiter processing, compressor processing, and analog/digital (A/D) conversion processing. The recorders 101 and 104 record data received from the preamplifiers 200 to 215, and the processing device 130 acquires the data recorded by the recorders 101 and 104 and performs acoustic signal generation, etc.

As illustrated in FIG. 1, the plurality of preamplifiers 200 to 207 is connected to each other via a digital audio interface in a daisy chain, and the preamplifiers 200 and 207 are connected to the recorder 101. Specifically, the preamplifiers 200 to 207 and the recorder 101 configure a ring network. In such a configuration, each of the preamplifiers 200 to 206 outputs data to the adjacent preamplifier, and all of the data transmitted from each preamplifier to the recorder 101 is input to the recorder 101 via the preamplifier 207. Similarly, all of control data transmitted from the recorder 101 to each preamplifier is relay-transmitted via the preamplifier 200.

For digital audio transmission between the preamplifiers 200 to 207 and the recorder 101, a multi-channel audio digital interface (MADI) defined as an Audio Engineering Society (AES) standard 10-1991 is used. The data transmission method, however, is not limited to the MADI method.

The preamplifiers 200 to 207 are daisy-chain connected to shorten the total length of connection cables that are used, compared to the case of directly connecting the recorder 101 to each preamplifier. This makes it possible to reduce system costs and improve the ease of installation.

Further, the preamplifiers 208 to 215 and the recorder 104 are also connected to each other in a daisy chain, similarly to the preamplifiers 200 to 207 and the recorder 101. Alternatively, all the preamplifiers 200 to 215 can be connected so as to be included in a single ring network. In this case, the acoustic processing system 10 can include only one of the recorders 101 and 104.

Next, the functional configuration of the acoustic processing system 10, which is schematically illustrated in FIG. 1, will be described in detail below with reference to FIG. 2. While the microphones 113 to 120, the preamplifiers 208 to 215, and the recorder 104 are omitted in FIG. 2, their configurations are similar to those of the microphones 105 to 112, the preamplifiers 200 to 207, and the recorder 101 in FIG. 2.

The microphone 105 includes a forward sound collection microphone 303, a backward sound collection microphone 304, a forward position sensor 305, and a backward position sensor 306. The forward sound collection microphone 303 is a directional microphone and collects sounds of the front of the microphone 105. The backward sound collection microphone 304 is also a directional microphone and collects sounds of the rear of the microphone 105. In the acoustic processing system according to the present exemplary embodiment, the microphone 105 is installed such that the forward sound collection microphone 303 collects sounds in the direction of the athletic field and the backward sound collection microphone 304 collects sounds in the direction of the audience. The forward sound collection microphone 303 and the backward sound collection microphone 304 can be different in not only the direction of the directivity but also sound collection distance and/or sound collection angle. Sound collection signals of the sounds collected by the forward sound collection microphone 303 and the backward sound collection microphone 304 are output to a compressor/limiter processing unit 400 of the preamplifier 200.

While the microphone 105 collects sounds in the front and the rear in the present exemplary embodiment, sounds to be collected are not limited the above-described sounds, and the microphone 105 can collect sounds, for example, in the right and left directions. Further, the microphone 105 can collect sounds from a plurality of different directions that is not limited to a predetermined direction and its opposite direction as described above. Further, the microphone 105 can include a single microphone or a non-directional microphone.

The forward position sensor 305 is provided near the front end of the microphone 105 and acquires coordinate information about the arrangement position. The backward position sensor 306 is provided near the rear end of the microphone 105 and acquires coordinate information about the arrangement position. Examples of a method for acquiring coordinate information include a method using the Global Positioning System (GPS). The coordinate information acquired by the forward position sensor 305 and the coordinate information acquired by the backward position sensor 306 are information for identifying the position and orientation of the microphone 105. The coordinates are output to a region calculation unit 402 of the preamplifier 200.

The configurations of the sensors provided to the microphone 105 are not limited to the above-described configurations but may have any configuration as long as the sensors are capable of acquiring information for identifying the position and orientation of the microphone 105. For example, a plurality of GPS sensors can be provided in arbitrary positions other than the front and rear ends of the microphone 105, and the sensors to be provided in the microphone 105 are not limited to the GPS sensors and can be gyro sensors, gravity sensors, acceleration sensors, and other types of sensors. Further, in the case in which the microphone 105 includes non-directional microphones, information for identifying the orientation of the microphone 105 does not have to be acquired. Further, the microphone 105 can communicate with other microphones using infrared communication, etc. to acquire the relative position and direction with respect to the other microphones.

Figure 3A:
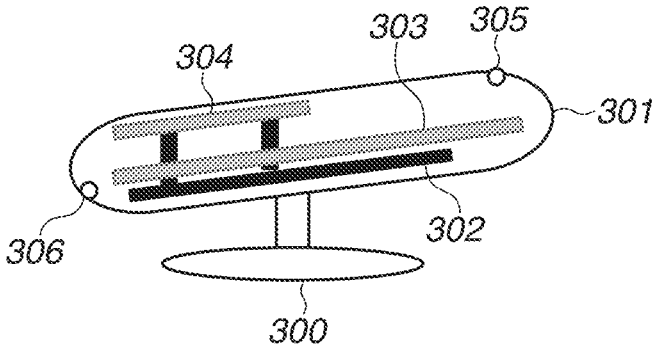
FIG. 3A illustrates a hardware configuration of a microphone, and 3B illustrates a hardware configuration of a processing device.

FIG. 3A illustrates an example of a physical configuration of the microphone 105. The microphone 105 further includes a stand 300, a windshield 301, and a grip 302 in addition to the above-described components. The configurations of the microphones 106 to 112 are similar to the configuration of the microphone 105.

The preamplifier 200 includes the compressor/limiter processing unit 400, a codec processing unit 401, the region calculation unit 402, a metadata calculation unit 403, a MADI encoding unit 404, and a MADI interface 405. The compressor/limiter processing unit 400 executes compressor processing to reduce differences in intensity between sounds, limiter processing for limiting sound volume peaks, and other processing on the sound collection signals input from the microphone 105. The codec processing unit 401 executes A/D conversion processing to convert analog signals processed by the compressor/limiter processing unit 400 into digital data.

The region calculation unit 402 calculates a sound collection region of the microphone 105 based on the coordinate information about the microphone 105 which is input from the forward position sensor 305, the coordinate information about the microphone 105 which is input from the backward position sensor 306, and the characteristics of the microphone 105. The sound collection region is a region in which the microphone 105 is capable of collecting sounds with a predetermined sensitivity and which is determined based on the position, orientation, and directivity of the microphone 105. Details of the characteristics of the microphone and the sound collection region will be described below. The metadata calculation unit 403 generates metadata indicating the sound collection region of the microphone 105 which is calculated by the region calculation unit 402.

The MADI encoding unit 404 multiplexes the acoustic data generated by the codec processing unit 401 and the metadata generated by the metadata calculation unit 403 and outputs the multiplexed data to the MADI interface 405. The MADI interface 405 outputs, to an MADI interface 405 of the preamplifier 201, data based on the data acquired from the MADI encoding unit 404 and the data input from an MADI interface 405 of the recorder 101.

The configurations of the preamplifiers 201 to 207 are similar to the configuration of the preamplifier 200, except that data is input to each of the MADI interfaces 405 of the preamplifiers 201 to 206 from the MADI interface 405 of the adjacent preamplifier. Further, the MADI interface 405 of the preamplifier 207 outputs data to the MADI interface 405 of the recorder 101.

The recorder 101 includes an MADI encoding unit 404, the MADI interface 405, and a MADI decoding unit 406. The configurations of the MADI encoding unit 404 and the MADI decoding unit 406 of the recorder 101 are similar to the configurations of the MADI encoding unit 404 and the MADI decoding unit 406 of the preamplifier 201 described above, except that control data is input from a channel control unit 410 of the processing device 130 to the MADI encoding unit 404 of the recorder 101 and is transmitted to each preamplifier via the MADI interface 405. Further, the MADI interface 405 of the recorder 101 outputs, to the MADI decoding unit 406, the data input from the MADI interface 405 of the preamplifier 207.

The MADI decoding unit 406 divides the data acquired from the MADI interface 405 of the recorder 101 into acoustic data and metadata and records the acoustic data and the metadata in an accumulation unit 407 of the processing device 130. Alternatively, the recorder 101 can include a holding unit configured to hold the acoustic data and the metadata.

The processing device 130 includes the accumulation unit 407, a region comparison unit 408, an acoustic generation unit 409, and the channel control unit 410. The accumulation unit 407 accumulates microphone information 450, a calibration result 451, metadata 452, acoustic data 453, and camera path information 454.

The microphone information 450 is information about the configuration of each of the microphones 105 to 120. The calibration result 451 is information about the position and orientation of each microphone that are measured at the time of installation of the microphones 105 to 120. The metadata 452 is metadata recorded by the MADI decoding units 406 of the recorders 101 and 104. The acoustic data 453 records the acoustic data recorded by the MADI decoding units 406 of the recorders 101 and 104. The camera path information 454 is information about the image capturing position and direction of video images reproduced together with the acoustic signals generated by the acoustic processing system 10.

The region comparison unit 408 compares the sound collection region of each microphone at the time of installation that is identified based on the microphone information 450 and the calibration result 451 with the sound collection region of the microphone that is identified based on the metadata 452. By this comparison, the region comparison unit 408 detects a change in the positions and orientations of the installed microphones and outputs the detection result to the channel control unit 410.

The acoustic generation unit 409 generates multi-channel acoustic signals by combining the acoustic data 453 using the combining parameter acquired from the channel control unit 410 and the camera path information 454. The generated acoustic signals are output to, for example, a speaker (not illustrated) constituting a 5.1 or 22.2 channel surround reproduction environment. The acoustic data generation by the acoustic generation unit 409 is executed in response to an operation performed by a user (hereinafter, "editing user") editing the acoustic signals.

The channel control unit 410 determines the combining parameter based on the microphone information 450 and the detection information acquired from the region comparison unit 408 and outputs the determined parameter to the acoustic generation unit 409. Further, the channel control unit 410 outputs, to the MADI encoding units 404 of the recorders 101 and 104, control data for controlling the preamplifiers 200 to 215 and the microphones 105 to 120. The output of information by the channel control unit 410 is executed in response to an operation by a user (hereinafter, "management user") managing the acoustic processing system 10. The editing user editing the acoustic signals and the management user managing the acoustic processing system 10 can be the same person or different persons.

Figure 3B:
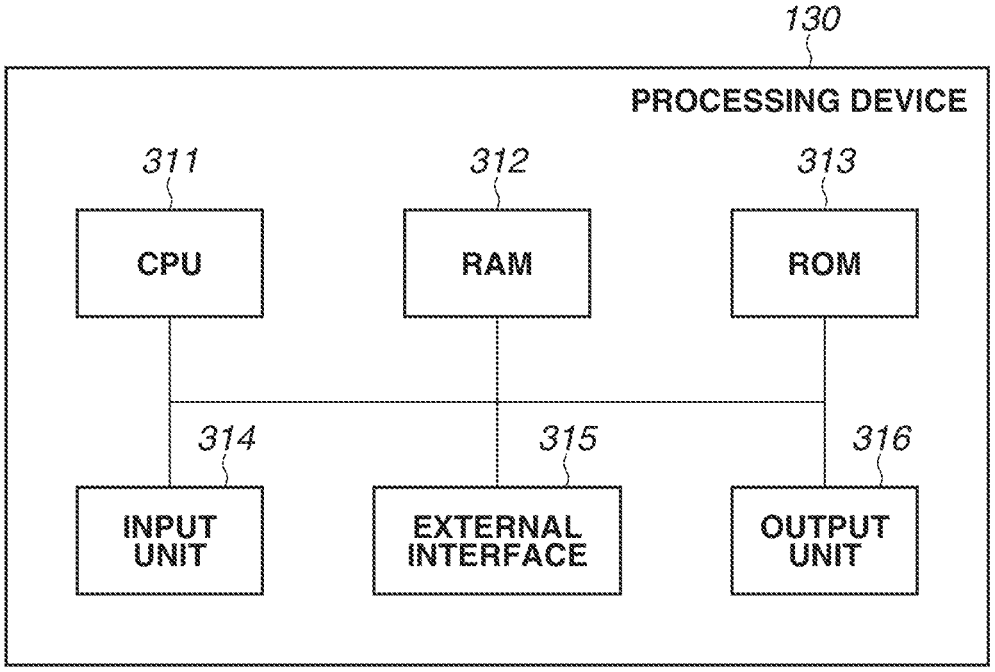

FIG. 3B illustrates an example of a hardware configuration of the processing device 130. The configurations of the preamplifiers 200 to 215 and the recorders 101 and 104 are similar to the configuration of the processing device 130. The processing device 130 includes a central processing unit (CPU) 311, a random-access memory (RAM) 312, a read-only memory (ROM) 313, an input unit 314, an external interface 315, and an output unit 316.

Figure 2:
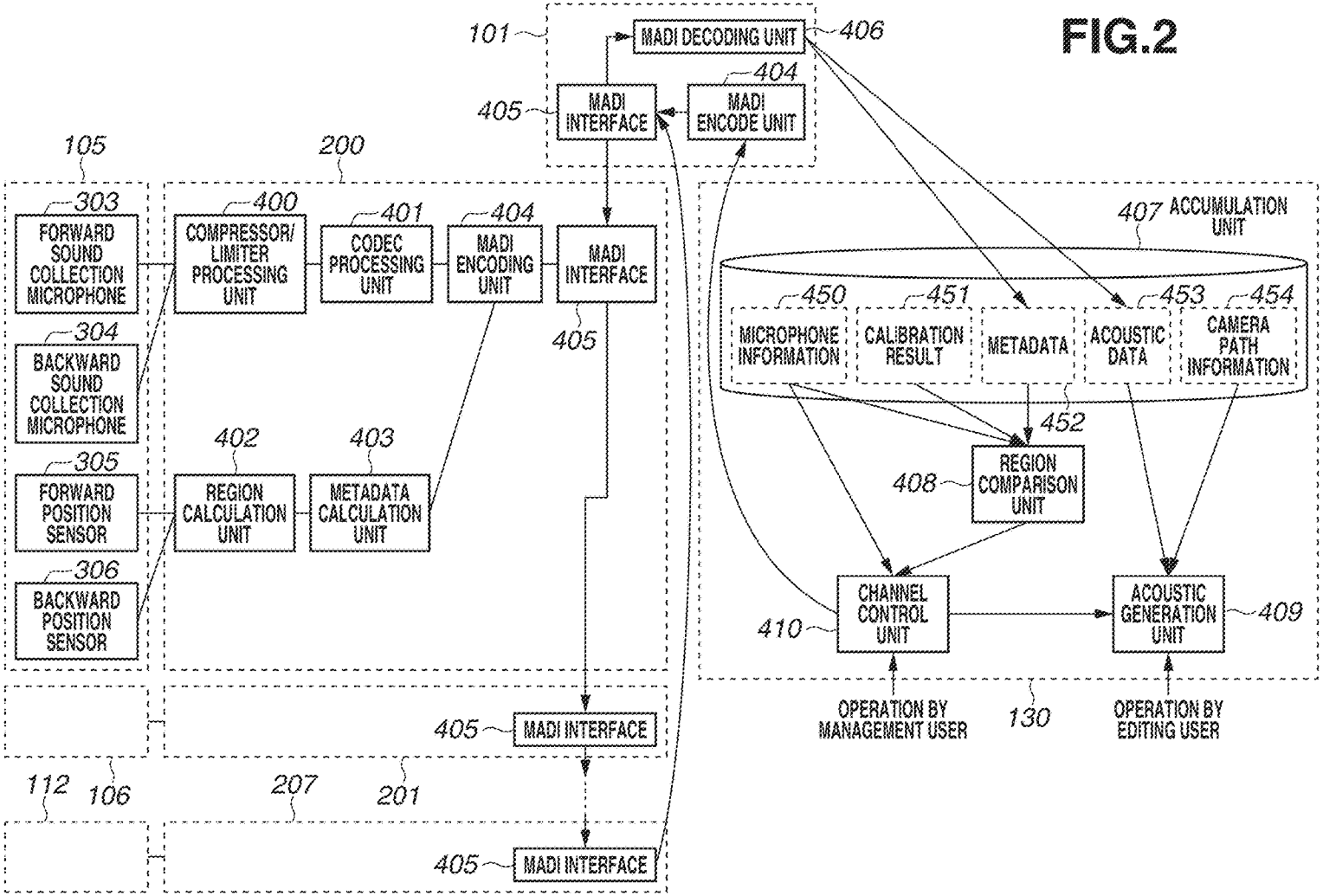
FIG. 2 schematically illustrates a functional configuration of the acoustic processing system.

The CPU 311 controls the entire processing device 130 using a computer program and data stored in the RAM 312 or the ROM 313 to realize various components of the processing device 130 illustrated in FIG. 2. Alternatively, the processing device 130 can include a single piece or a plurality of pieces of dedicated hardware different from the CPU 311, and at least part of the processing performed by the CPU 311 can be performed by the dedicated hardware. Examples of dedicated hardware include an application-specific integrated circuit (ASIC), a field-programmable gate array (FPGA), and a digital signal processor (DSP). The RAM 312 temporarily stores computer programs and data read from the ROM 313, data supplied from an external device via the external interface 315, etc. The ROM 313 holds computer programs and data that does not require any change.

The input unit 314 includes, for example, an operation button, a jog dial, a touch panel, a keyboard, and a mouse and receives user operations and inputs various instructions to the CPU 311. The external interface 315 communicates with external devices such as the recorder 101 and the speaker (not illustrated). The communication with the external devices can be performed using wires or cables, such as local area network (LAN) cables or audio cables, or can be performed wirelessly via antennas. The output unit 316 includes a display unit such as a display and an audio output unit such as a speaker and displays a graphical user interface (GUI) with which a user operates the processing device 130, and outputs guide audio.

The foregoing describes the configuration of the acoustic processing system 10. The configurations of the devices included in the acoustic processing system 10 are not limited to those described above. For example, the processing device 130 and the recorders 101 and 104 can be configured in an integrated manner. Further, the acoustic generation unit 409 can be separately configured, as a generation device, from the processing device 130. In this case, the processing device 130 outputs the parameters determined by the channel control unit 410 to the acoustic generation unit 409 of the generation device, and the acoustic generation unit 409 performs acoustic signal generation based on the input parameters.

Figure 4:
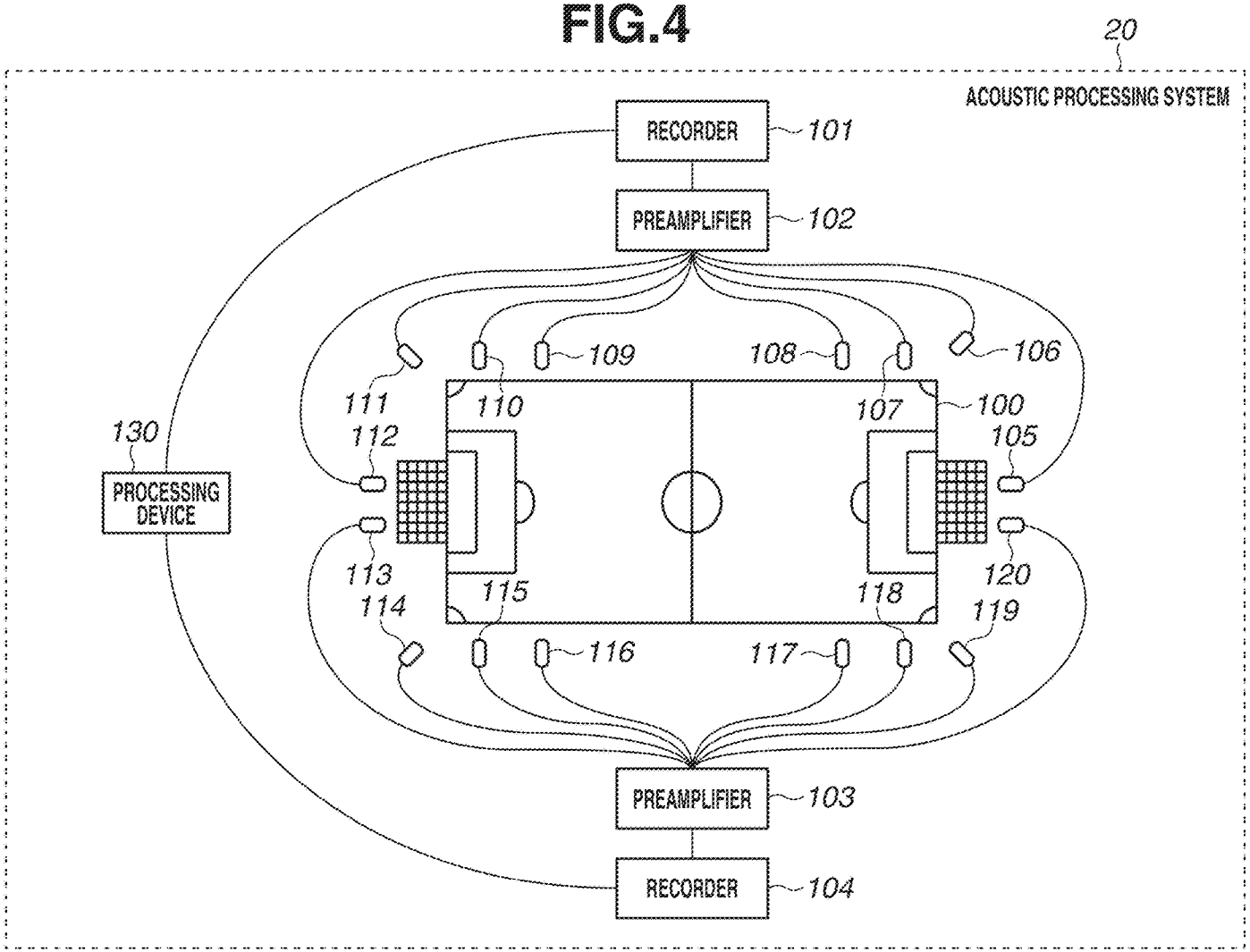
FIG. 4 illustrates another example of the configuration of the acoustic processing system.

Further, as illustrated in FIG. 1, the acoustic processing system 10 includes the plurality of preamplifiers 200 to 215 corresponding to the plurality of microphones 105 to 120, respectively. As described above, the signal processing on the sound collection signals is shared and performed by the plurality of preamplifiers to prevent an increase in the processing amount of each preamplifier. Alternatively, the number of preamplifiers can be less than the number of microphones as in an acoustic processing system 20 illustrated in FIG. 4.

In the acoustic processing system 20, sound collection signals of sounds collected by the microphones 105 to 112 are output to a preamplifier 102 through analog transmission. Then, the preamplifier 102 performs signal processing on the input sound collection signals and collectively outputs, to the recorder 101, the processed sound collection signals as sound collection signals of a plurality of channels. Similarly, a preamplifier 103 performs signal processing on sound collection signals of sounds collected by the microphones 113 to 120 and collectively outputs, to the recorder 104, the processed sound collection signals as sound collection signals of a plurality of channels. The present exemplary embodiment is also realized by use of the acoustic processing system 20 as described above.

[Operation Flow]

Figure 5:
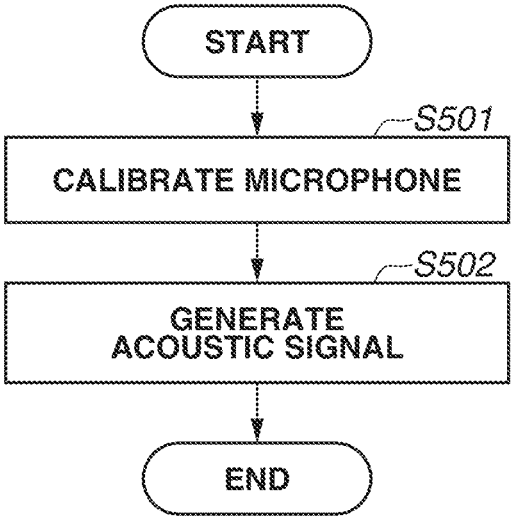
FIG. 5 is a flowchart illustrating processing performed by the processing device.

A flow of operations performed by the processing device 130 will be described below with reference to FIG. 5. The process illustrated in FIG. 5 is started at the timing at which the devices such as the microphones 105 to 120 included in the acoustic processing system 10 are installed and the processing device 130 receives a user operation to start operations of the acoustic processing system 10. The operation to start the operations is performed during, for example, a preparation period before a start of a game that is a sound collection target. Then, the process illustrated in FIG. 5 is ended at the timing at which the processing device 130 receives an end operation performed after the game, i.e., the sound collection target, is ended. The timings to start and end the process illustrated in FIG. 5 are not limited to the above-described timings. In the present exemplary embodiment, a case in which the sound collection and the acoustic signal generation are performed in parallel in real time will mainly be described below.

The CPU 311 develops a program stored in the ROM 313 into the RAM 312 and executes the program to realize the process illustrated in FIG. 5. Alternatively, at least part of the process illustrated in FIG. 5 can be realized by a single piece or a plurality of pieces of dedicated hardware different from the CPU 311.

In step S501, the processing device 130 executes processing to adjust (calibrate) the installed microphone. Details of the processing in step S501 will be described below with reference to FIG. 6. In step S502, the processing device 130 executes acoustic signal generation processing based on sound collection signals. Details of the processing in step S502 will be described below with reference to FIG. 7. If the processing device 130 ends the processing in step S502, the processing flow illustrated in FIG. 5 is ended.

The process in FIG. 5 is executed so that the acoustic processing system 10 generates multi-channel acoustic signals. Specifically, the sound collection signals of the plurality of channels that are based on the sounds collected by the plurality of microphones 105 to 120 are combined using the parameters corresponding to the installation positions and directions of the respective microphones to generate acoustic signals. Then, the generated acoustic signals are reproduced in an appropriate reproduction environment so that, for example, how the sounds are heard in specific positions in the field 100, i.e., a sound collection target space, is reproduced.

In a case in which, for example, sounds are collected in an athletic field, the positions and orientations of the installed microphones can be changed due to contact of a player or a ball against the microphone or bad weather such as strong wind. In such a case, if the combining processing is performed on sound collection signals of sounds collected after the change using the parameters corresponding to the positions and orientations of the microphone before the change, acoustic signals from which appropriate sounds are reproducible are less likely to be generated. Specifically, voices of a player can be heard from a direction in which the player is not present in the field 100.

Thus, the acoustic processing system 10 according to the present exemplary embodiment detects a change in the state of the microphone, re-determines parameters based on the detection results, and then performs combining processing on sound collection signals to generate acoustic signals from which appropriate sounds are reproducible. Further, the acoustic processing system 10 determines the parameters based on the state of the microphone before the change and the state of the microphone after the change. This makes it possible to generate acoustic signals from which more appropriate sounds are reproducible, compared to the case in which the parameters are determined based only on the state of the microphone after the change. Alternatively, the acoustic processing system 10 can determine the parameters based only on the state of the microphone after the change.

[Calibration]

Figure 6:
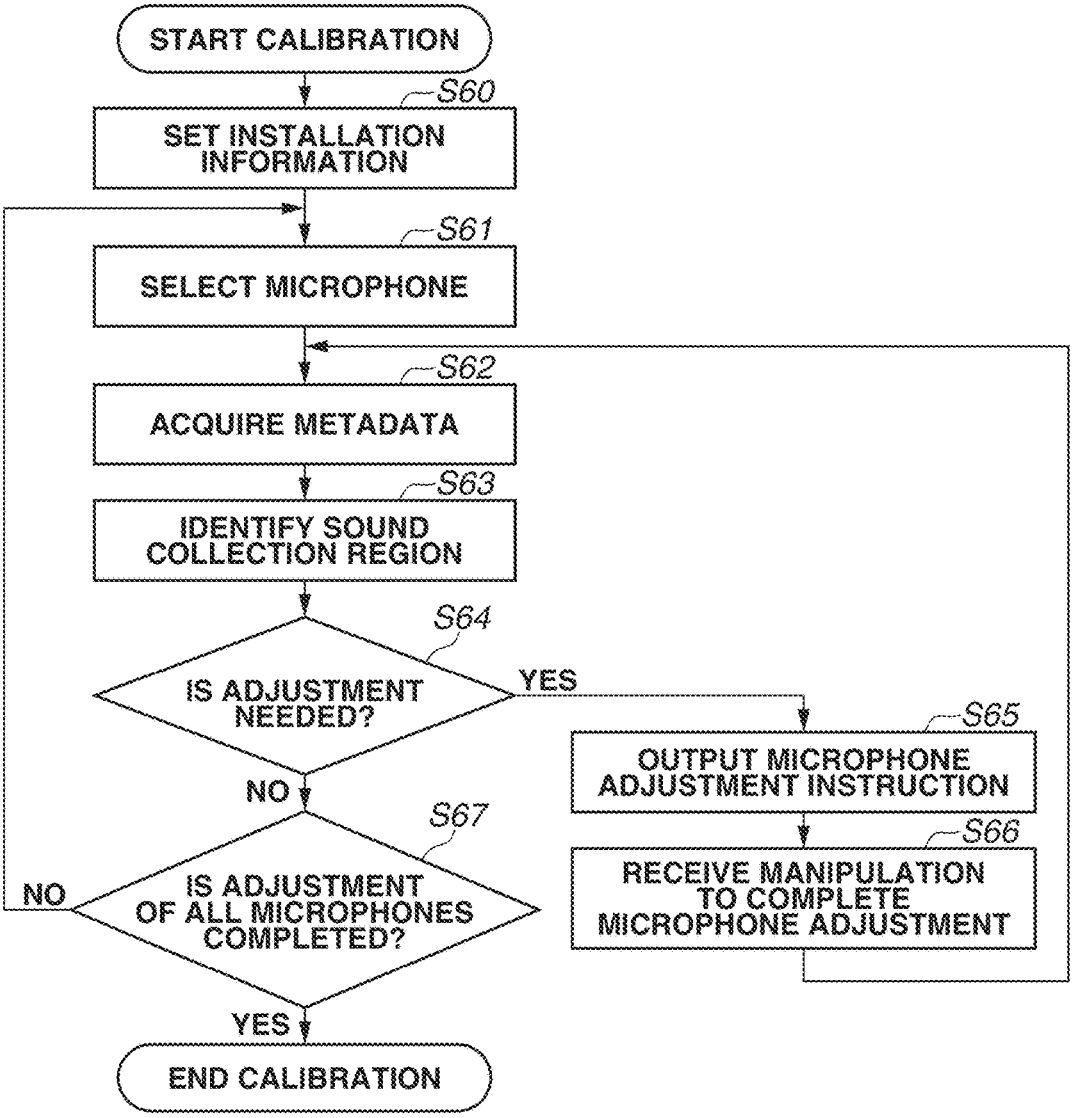
FIG. 6 is a flowchart illustrating a calibration process performed by the processing device.

Next, details of the processing in step S501 in FIG. 5 will be described below with reference to FIG. 6. In step S60, the processing device 130 stores in the accumulation unit 407 installation information about the microphones 105 to 120 as part of the microphone information 450. The installation information is information indicating a target installation position and a target installation direction of each microphone. The installation information can be set based on an operation by the management user or can be set automatically. The microphone information 450 stored in the accumulation unit 407 can contain information about characteristics such as the directivity of each microphone in addition to the installation information. The information about characteristics can also be stored as the installation information in step S60.

In step S61, the processing device 130 selects a calibration target microphone. In step S62, the processing device 130 reads from the accumulation unit 407 metadata corresponding to the microphone selected in step S61. The metadata read in step S62 is data indicating the sound collection region calculated by the region calculation unit 402 of the preamplifier based on the coordinate information about the microphone acquired by the forward position sensor 305 and the backward position sensor 306 and the characteristics of the microphone. In step S63, the processing device 130 identifies the sound collection region of the microphone selected in step S61 based on the metadata read in step S62.

In step S64, the processing device 130 refers to the microphone information 450 and the sound collection region identified in step S63 and determines whether the microphone selected in step S61 needs to be adjusted. For example, if the difference between the target sound collection region of the selected microphone that is identified from the microphone information 450 and the actual sound collection region identified in step S63 is greater than a threshold value, the processing device 130 determines that the selected microphone needs to be adjusted (YES in step S64), and the processing proceeds to step S65. On the other hand, if the processing device 130 determines that the selected microphone does not need to be adjusted (NO in step S64), the processing device 130 stores in the accumulation unit 407 the sound collection region identification result in step S63 as the calibration result 451, and the processing proceeds to step S67. A method for determining whether the selected microphone needs to be adjusted is not limited to the method described above. For example, the processing device 130 can display images of the target sound collection region and the actual sound collection region and determines whether the selected microphone needs to be adjusted based on an operation input by the management user according to the displayed images. Further, the sound collection region identification is not required, and whether the selected microphone needs to be adjusted can be determined based on the position and direction of the microphone.

In step S65, the processing device 130 outputs a microphone adjustment instruction. The microphone adjustment instruction is, for example, information indicating a microphone to be adjusted and information indicating a necessary amount of adjustment. The processing device 130 can output the microphone adjustment instruction in the form of an image or audio to the management user or can output the microphone adjustment instruction to a user who is in charge of installation of microphones and different from the management user. In step S66, the processing device 130 receives an operation to complete the microphone adjustment, and the processing returns to step S62.

In step S67, the processing device 130 determines whether the adjustment of all the microphones in the acoustic processing system 10 is completed. If the processing device 130 determines that the adjustment of all the microphones is completed (YES in step S67), the process in FIG. 6 is ended. On the other hand, if the processing device 130 determines that the adjustment of all the microphones is not completed (NO in step S67), the processing returns to step S61, and an unadjusted microphone is newly selected. The process in FIG. 6 described above is executed to realize an appropriate installation state of the microphone.

[Acoustic Signal Generation]

Next, details of the processing in step S502 in FIG. 5 will be described below with reference to FIG. 7. In step S70, the region comparison unit 408 selects a microphone to be checked for a sound collection region. In steps S71 and S72, the region comparison unit 408 performs processing similar to the processing in steps S62 and S63 in FIG. 6 described above to identify a sound collection region of the microphone selected in step S70.

In step S73, the region comparison unit 408 compares the sound collection region of the microphone that is identified in step S72 with the sound collection region of the microphone that is specified by the calibration result 451. The sound collection region identified in step S72 is the sound collection region corresponding to the latest coordinate information acquired by the forward position sensor 305 and the backward position sensor 306, whereas the sound collection region specified by the calibration result 451 is the sound collection region at the time point at which the processing in step S501 is ended. Details of the processing in step S73 will be described below with reference to FIG. 10. In step S74, the region comparison unit 408 determines whether the difference between the sound collection regions compared in step S73 is within a predetermined range. If the region comparison unit 408 determines that the difference between the sound collection regions is within the predetermined range (YES in step S74), the processing proceeds to step S76. On the other hand, if the region comparison unit 408 determines that the difference between the sound collection regions is out of the predetermined range (NO in step S74), the processing proceeds to step S75. Instead of determining the difference between the sound collection regions, the region comparison unit 408 can determine whether the difference in the position and/or orientation of the microphone from those at the time of calibration is within a predetermined range.

In step S75, the channel control unit 410 determines that a change in the state of the installed microphones is detected by the region comparison unit 408, and performs processing for re-setting the parameters for use in acoustic signal generation. Details of the processing in step S75 will be described below with reference to FIG. 11. If the re-setting processing is ended, the processing proceeds to step S76.

In step S76, the acoustic generation unit 409 performs acoustic signal generation based on the acoustic data 453 stored in the accumulation unit 407. The acoustic data 453 is constituted of the sound collection signals of the plurality of channels corresponding to the results of signal processing performed by the plurality of preamplifiers 200 to 215 on the sound collection signals of sounds collected by the plurality of microphones 105 to 120. The acoustic generation unit 409 generates acoustic signals by combining the sound collection signals of one or more of the plurality of channels using the parameters set in step S75. In a case in which the re-setting processing in step S75 is not executed, the acoustic generation unit 409 generates acoustic signals using parameters based on initial settings. The parameters based on the initial settings are parameters that are set based on the microphone information 450, the calibration result 451, and the camera path information 454 after the processing in step S501 is executed. The parameters are parameters suitable for the arrangement of the microphones 105 to 120 corresponding to the installation information set in step S60.

In step S77, the channel control unit 410 determines whether to continue the acoustic signal generation. For example, if an operation to end the acoustic signal generation is received, the channel control unit 410 determines not to continue the generation (NO in step S77), and the process in FIG. 7 is ended. On the other hand, if the channel control unit 410 determines to continue the generation (YES in step S77), the processing returns to step S70 to select a new microphone.

In the microphone selection in step S70, for example, the microphones 105 to 120 are selected in this order, and after steps S71 to S76 are executed with respect to all the microphones, the microphone 105 is selected again. A method of selecting a microphone in step S70 is not limited to the above-described method.

Figure 7:
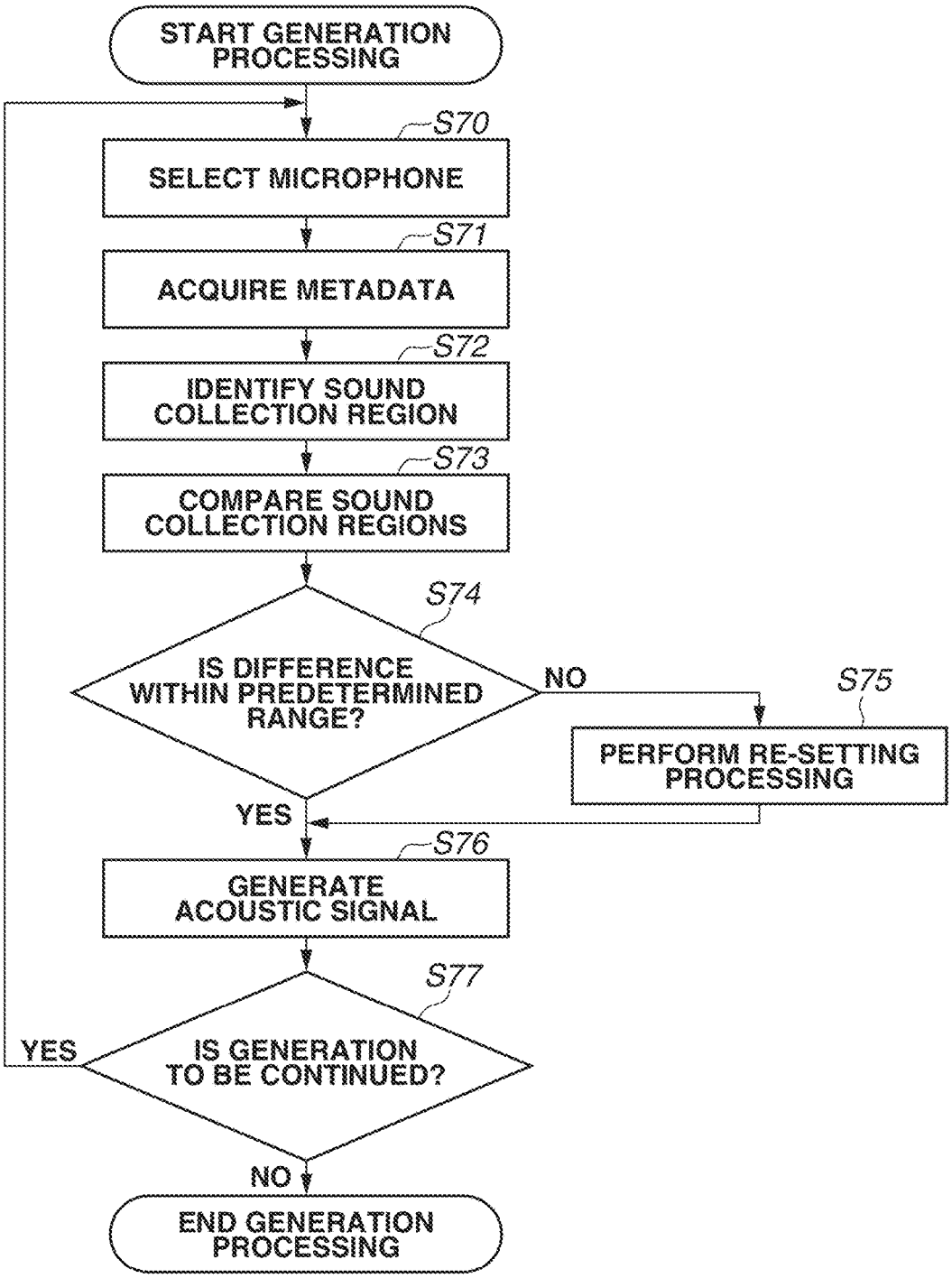
FIG. 7 is a flowchart illustrating an acoustic signal generation process performed by the processing device.

The process in FIG. 7 described above is executed so that the sound collection region of the microphone is continuously checked during the sound collection and acoustic signals are generated using the parameters that are set according to a change in the state of the microphone.

[Sound Collection Region Calculation]

Next, a process of calculating the sound collection regions of the microphone by the preamplifier will be described below with reference to FIG. 8. The sound collection region is a region in which the microphone is capable of collecting sounds with a predetermined sensitivity. The sound collection region calculated by the preamplifier is transmitted as metadata to the accumulation unit 407, which thereby enables the processing device 130 to identify the sound collection region of the microphone in steps S62 and S63 described above.

Figure 8:
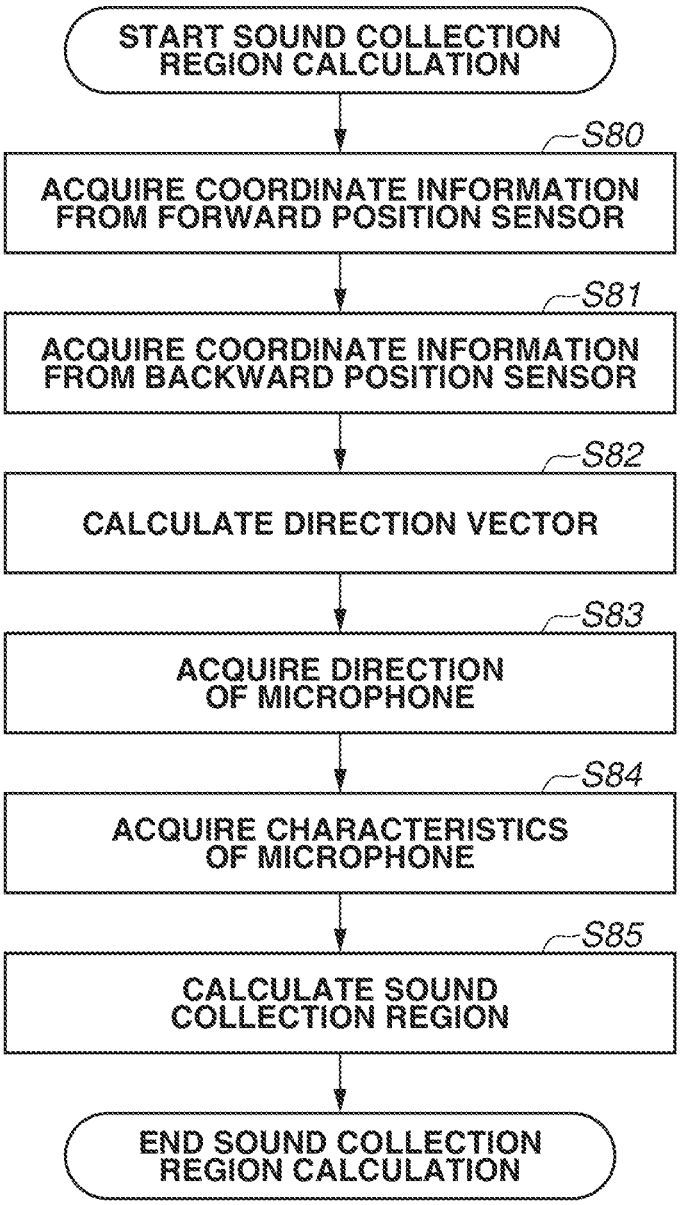
FIG. 8 is a flowchart illustrating a sound collection region calculation process performed by a preamplifier.

The process illustrated in FIG. 8 is executed periodically by each of the preamplifiers 200 to 215 after the acoustic processing system 10 is started to operate. The start timing of the process in FIG. 8 is not limited to the above-described timing and, for example, the process in FIG. 8 can be started at the timing at which the coordinate information is input from the forward position sensor 305 and the backward position sensor 306 to the region calculation unit 402 of the preamplifier. The CPU 311 of the preamplifier loads a program stored in the ROM 313 into the RAM 312 and executes the loaded program to realize the process in FIG. 8. Alternatively, at least part of the process in FIG. 8 can be realized by a single piece or a plurality of pieces of hardware different from the CPU 311.

In step S80, the region calculation unit 402 acquires the coordinate information from the forward position sensor 305 of the corresponding microphone. In step S81, the region calculation unit 402 acquires the coordinate information from the backward position sensor 306 of the corresponding microphone. In step S82, the region calculation unit 402 calculates a direction vector based on the coordinate information acquired in step S80 and the coordinate information acquired in step S81.

In step S83, the region calculation unit 402 acquires the direction of the corresponding microphone based on the direction vector calculated in step S82. In the present exemplary embodiment, the direction of a microphone refers to the direction in which the microphone has directivity. The direction of the forward position sensor 305 with respect to the backward position sensor 306 is the direction of the forward sound collection microphone 303, and the direction of the backward position sensor 306 with respect to the forward position sensor 305 is the direction of the backward sound collection microphone 304.

In step S84, the region calculation unit 402 acquires the information indicating the characteristics of the corresponding microphone. The characteristics of a microphone refer to information containing the sound collection distance and the sound collection angle of the microphone. The region calculation unit 402 can acquire the information indicating the characteristics of the microphone directly from the microphone or can read the information set in advance to the preamplifier based on a user operation, etc. In step S85, the region calculation unit 402 calculates the sound collection region of the corresponding microphone based on the coordinate information acquired in step S80 and the coordinate information acquired in step S81, the direction acquired in step S83, and the characteristics acquired in step S84, and the process in FIG. 8 is ended.

Figure 9A:
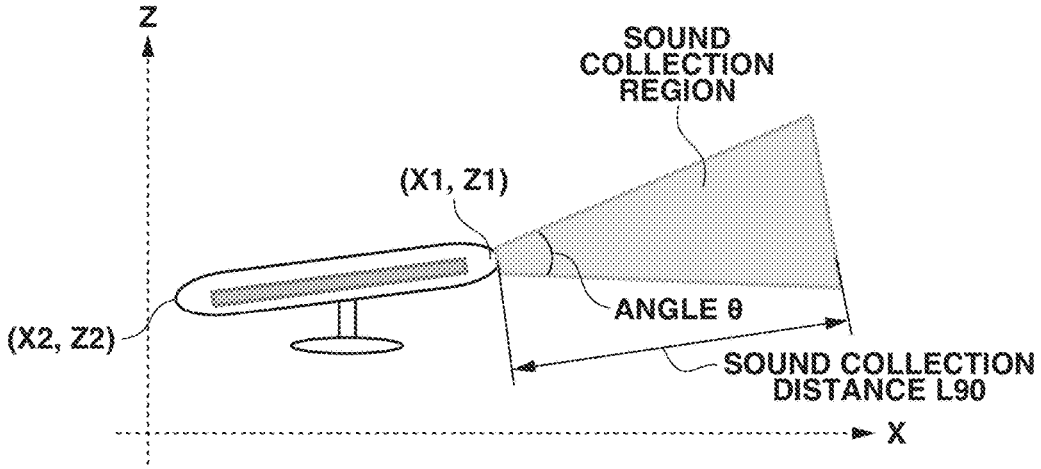
FIGS. 9A and 9B illustrate a sound collection region of the microphone.
Figure 9B:
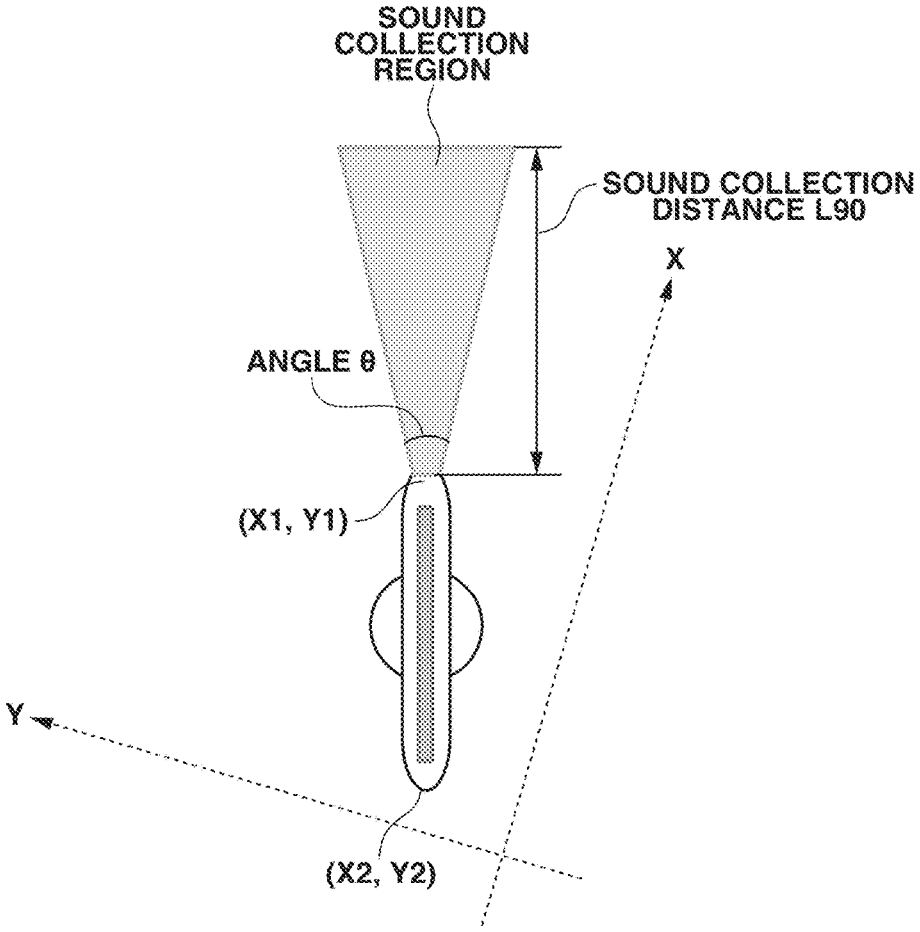

FIG. 9A illustrates an example of the microphone and the sound collection region of the microphone in a viewpoint in a Y-axis direction (horizontal direction) in an XYZ space. Further, FIG. 9B illustrates an example in a viewpoint in the Z-axis direction. On the X-Z plane in FIG. 9A, the coordinates of the forward position sensor 305 and the backward position sensor 306 are (X1, Z1) and (X2, Z2), respectively, and the direction vector calculated in step S83 is expressed as (X1-X2, Z1-Z2). Similarly, in FIG. 9B, the coordinates of the forward position sensor 305 and the backward position sensor 306 are (X1, Y1) and (X2, Y2), respectively, and the direction vector calculated in step S83 is expressed as (X1-X2, Y1-Y2). Further, the sound collection distance of the forward sound collection microphone 303 is a sound collection distance L90, and the sound collection angle is an angle θ as specified in FIGS. 9B and 9C. The sound collection distance L90 and the sound collection angle θ are determined according to the type and settings of the microphone. While only the sound collection region of the forward sound collection microphone 303 is illustrated in FIGS. 9A and 9B, the sound collection region of the backward sound collection microphone 304 exists on the opposite side of the microphone.

[Operation: Sound Collection Region Comparison]

Next, details of the processing in step S73 in FIG. 7 will be described below with reference to FIG. 10. In step S1000, the region comparison unit 408 identifies the sound collection region of the microphone at the time of calibration based on the calibration result 451. In step S1001, the region comparison unit 408 calculates an overlapping region of the sound collection region identified from the metadata 452 in step S72 and the sound collection region identified from the calibration result 451 in step S1000.

In step S1002, the region comparison unit 408 checks a threshold value setting mode. The setting mode is determined, for example, according to an operation by the management user. If the threshold value setting mode is set to a mode in which the threshold value is set by the user (YES in step S1002), the processing proceeds to step S1003. On the other hand, if the threshold value setting mode is set to a mode in which the threshold value is automatically set using a variable number held in the system (NO in step S1002), the processing proceeds to step S1004. In step S1003, the region comparison unit 408 acquires the threshold value based on an input operation by the user. In step S1004, on the other hand, the region comparison unit 408 acquires the threshold value based on the variable number held in the system.

In step S1005, the region comparison unit 408 compares the size of the overlapping region calculated in step S1001 with the threshold value acquired in step S1003 or S1004. In step S1006, the region comparison unit 408 determines whether the threshold value is greater than the overlapping region. If the threshold value is greater than the overlapping region (YES in step S1006), the processing proceeds to step S1007. On the other hand, if the threshold value is not greater than the overlapping region (NO in step S1006), the processing proceeds to S1008.

Figure 10:
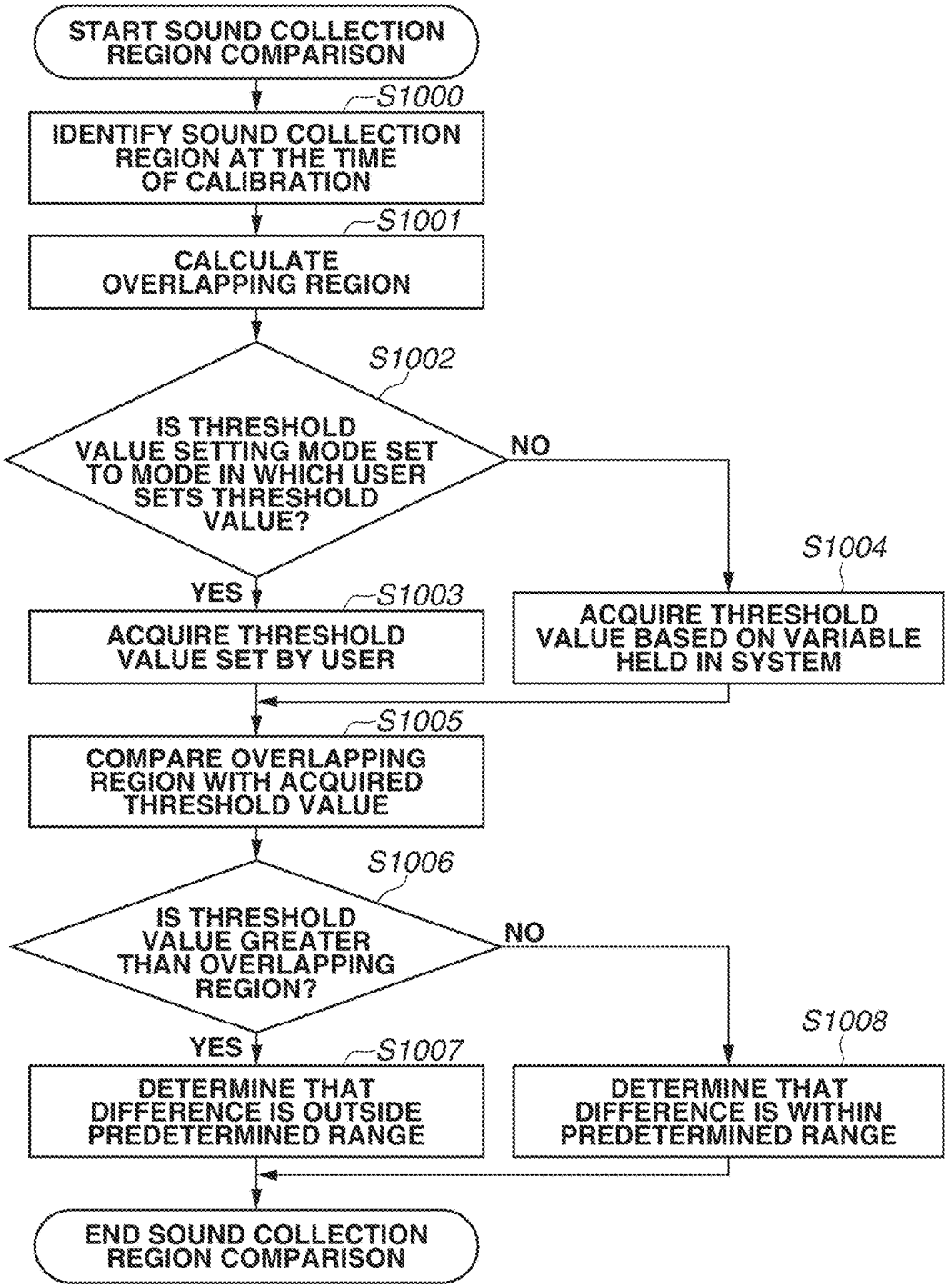
FIG. 10 is a flowchart illustrating a sound collection region comparison process performed by the processing device.

In step S1007, the region comparison unit 408 determines that the difference between the sound collection region identified based on the metadata 452 and the sound collection region identified based on the calibration result 451 is outside a predetermined range, and the process in FIG. 10 is ended. In step S1008, on the other hand, the region comparison unit 408 determines that the difference between the sound collection regions is within the predetermined range, and the process in FIG. 10 is ended.

[Parameter Re-Setting Processing]

Next, details of the processing in step S75 in FIG. 7 will be described below with reference to FIG. 11. The processing in step S75 is executed if a change in at least any of the states of the plurality of microphones 105 to 120 is detected by the region comparison unit 408. In step S1100, the channel control unit 410 acquires, from the calibration result 451, the sound collection region, acquired at the time of calibration, of the target microphone from which the change in the state is detected, i.e., the sound collection region before the change in the state.

In step S1101, the channel control unit 410 calculates an overlapping region of the sound collection region of the target microphone before the change and the sound collection region of another microphone. If there is also a change in the state of the other microphone, the channel control unit 410 calculates an overlapping region of the sound collection region of the target microphone before the change and the sound collection region of the other microphone after the change.

In step S1102, the channel control unit 410 determines, based on the overlapping region calculated in step S1101, a substitutable region, in which sounds are collectable using the other microphone, from a region that has turned to be outside the sound collection region of the target microphone due to the state change. In step S1103, the channel control unit 410 determines, based on the camera path information 454 stored in the accumulation unit 407, a region from which sounds need to be collected to generate multi-channel acoustic signals. For example, if the image capturing position specified by the camera path information 454 is within the athletic field and acoustic signals corresponding to the image capturing position are to be generated, the channel control unit 410 determines a region within a predetermined distance from the image capturing position as the region from which sounds need to be collected.

In step S1104, the channel control unit 410 determines whether the region determined in step S1103 includes the substitutable region determined in step S1102. If the channel control unit 410 determines that the substitutable region is included (YES in step S1104), the processing proceeds to step S1105. On the other hand, if the channel control unit 410 determines that the substitutable region is not included (NO in step S1104), the processing proceeds to step S1106.

In step S1105, the channel control unit 410 re-sets the parameters such that at least part of the sounds of the region in which the target microphone collects sounds before the state change is substituted by sounds collected by the other microphone. Examples of the parameters to be set in step S1105 include parameters for the combining ratio of sound collection signals of the plurality of channels in the acoustic signal generation. Details of the parameters are not limited to those described above, and parameters for phase correction and/or amplitude correction can be included.

In step S1106, on the other hand, the channel control unit 410 sets the parameters such that acoustic signal generation is performed without using the other microphone as a substitute. For example, the parameters are set such that the target microphone is deemed to not present and acoustic signals are generated from sound collection signals of sounds collected by the other microphone. Further, for example, parameters corresponding to the sound collection regions of the respective microphones after the state change are set regardless of the sound collection regions before the state change.

Figure 11:
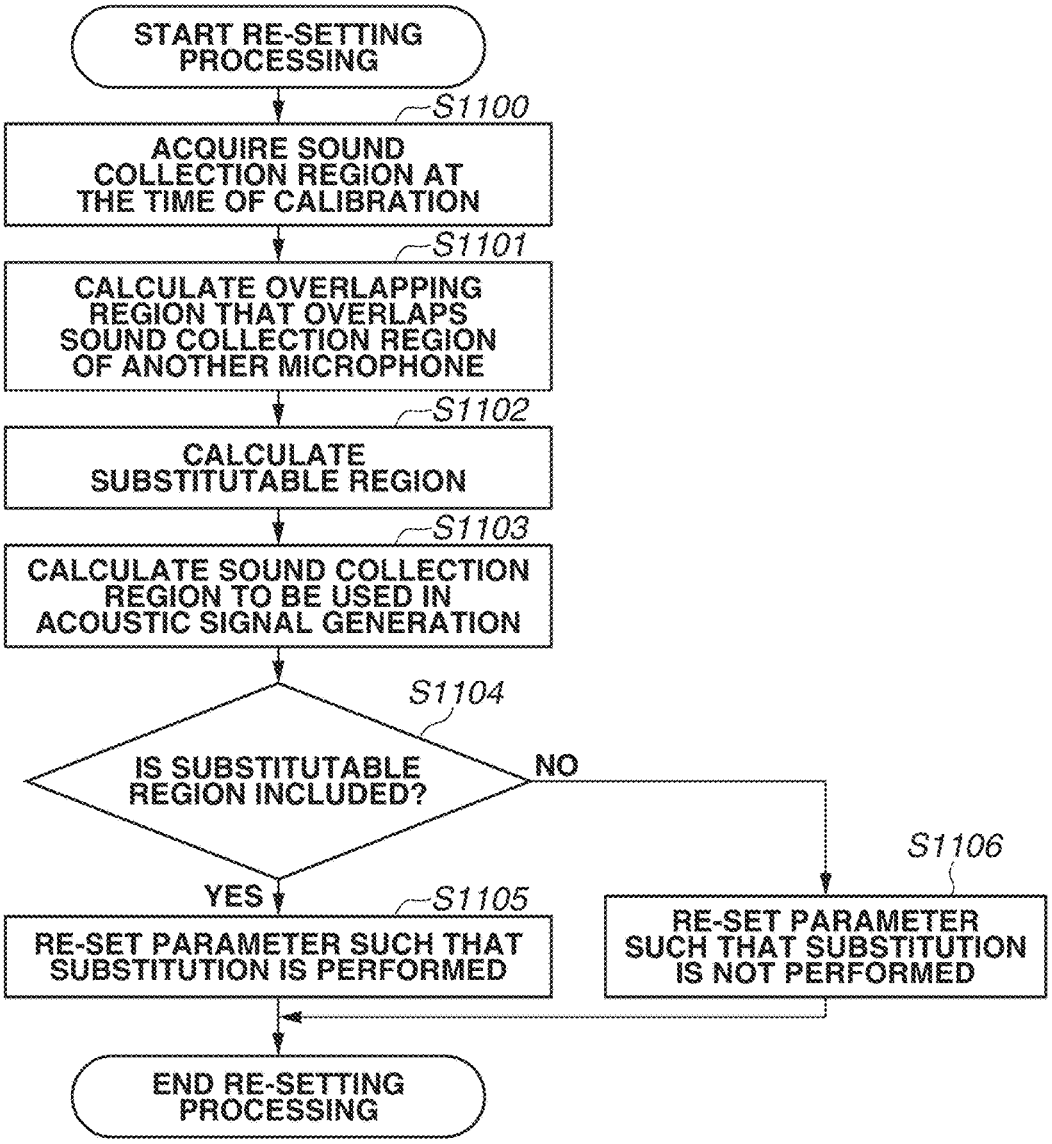
FIG. 11 is a flowchart illustrating a parameter setting process performed by the processing device.

If the parameter re-setting is performed in step S1105 or S1106, the process in FIG. 11 is ended. The process in FIG. 11 described above is executed to enable the channel control unit 410 to determine the parameters for use in the acoustic signal generation based on the states of the plurality of microphones before the state change and the states of the plurality of microphones after the state change. In this way, even if there is a change in the state of the microphone, a significant change in how the sounds reproduced using the generated acoustic signals are heard is prevented.

Alternatively, the channel control unit 410 can determine the parameters based on the position and orientation of the microphone before and after the change instead of using the results of sound collection region identification. In this case, the parameters can be determined such that another microphone similar in position and orientation to the target microphone before the state change is used as a substitute.

[Example of Change in State]

Figure 12:
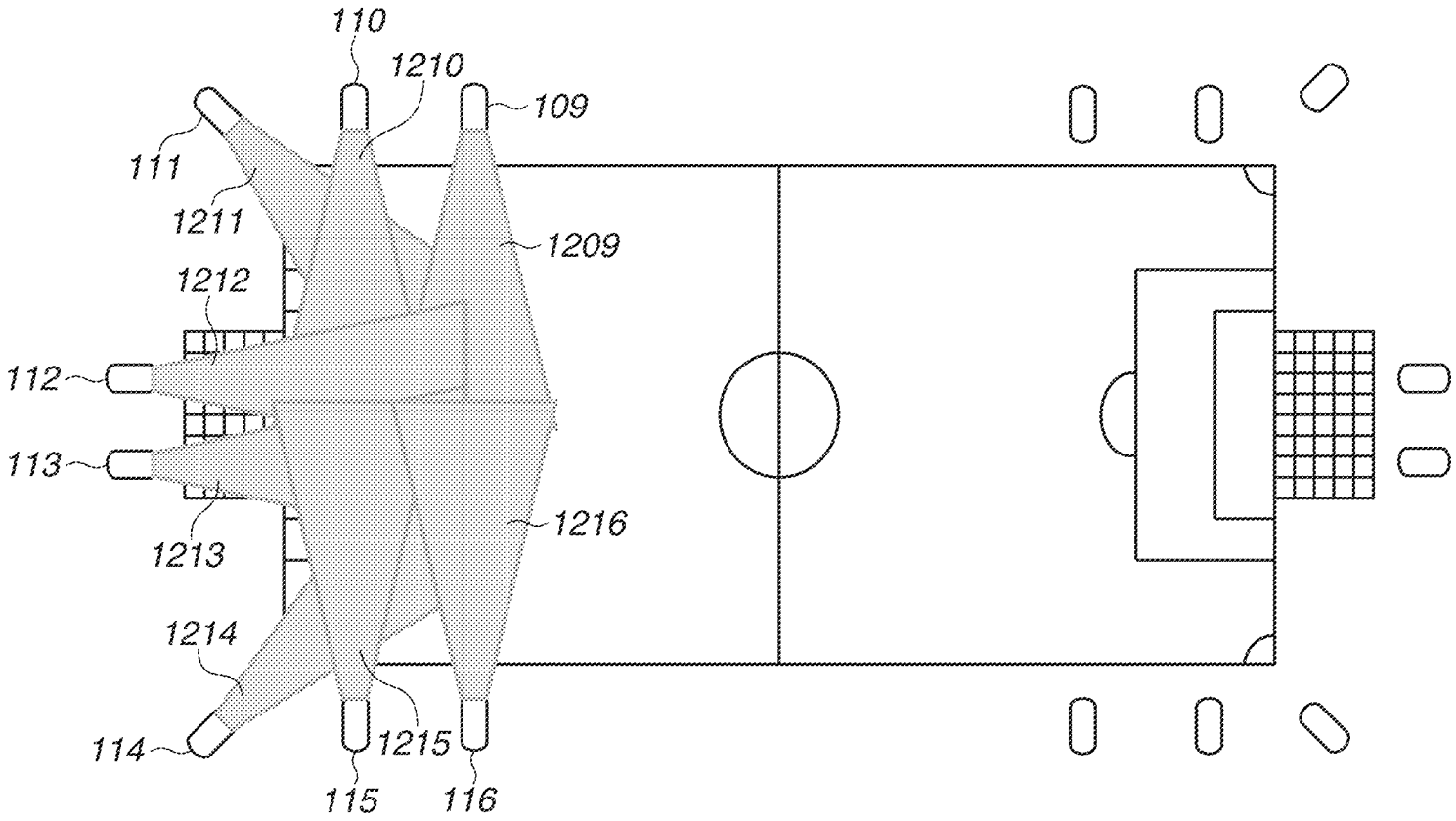
FIG. 12 illustrates an example of a state of the microphone before a change.
Figure 13:
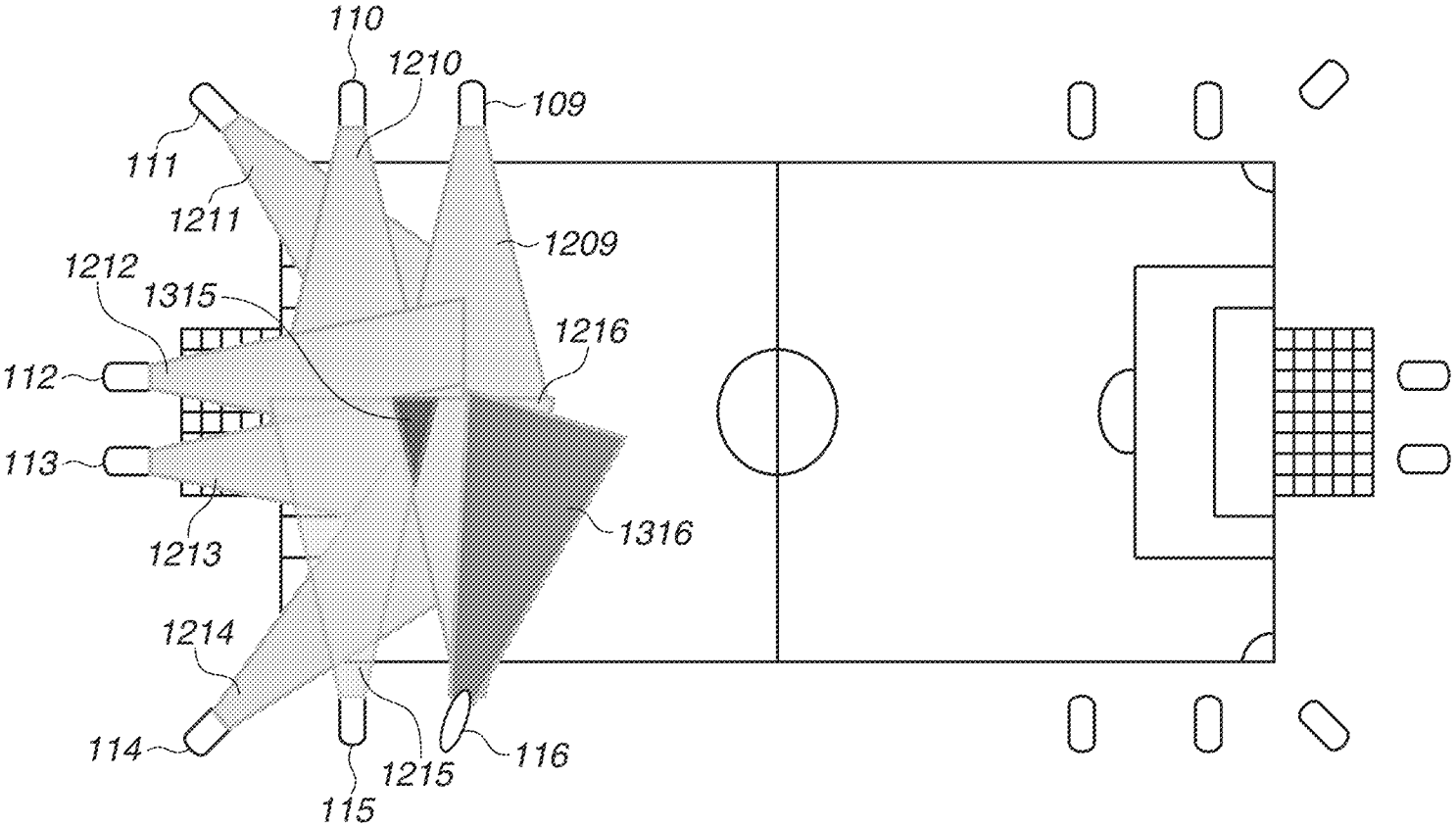
FIG. 13 illustrates an example of the state of the microphone after the change.

An example of a change in the state of the microphone will be described below with reference to FIGS. 12 and 13. FIG. 12 illustrates the microphones 109 to 116 and sound collection regions 1209 to 1216 of the microphones 109 to 116 when installed. On the other hand, FIG. 13 illustrates the state in which the orientation of the microphone 116 is changed due to an unknown cause from the state illustrated in FIG. 12. The sound collection region of the microphone 116 is changed from the sound collection region 1216 to a sound collection region 1316.

The sound collection region 1216 of the microphone 116 before the change overlaps the sound collection region 1215 of the microphone 115 in an overlapping region 1315. Thus, the processing device 130 re-sets the parameter for combining sound collection signals to substitute the sound collection signals of sounds collected by the microphone 115 for part of the sound collection signals of sounds collected by the microphone 116. In this way, sounds of the sound collection region 1316 and the overlapping region 1315 are treated as if the sounds are both collected by the microphone 116 in acoustic signal generation, and acoustic signals are generated such that a change in how the sounds are heard from that before the state change is reduced.

In the example in FIG. 13, the overlapping region of the sound collection region 1216 of the microphone 116 before the change and the sound collection region 1316 after the change is large, so that the processing device 130 generates acoustic signals using the sound collection signals of the channel corresponding to the microphone 116 even after the change. On the other hand, the processing device 130 can determine, based on the states of the microphone 116 before and after the change, whether to use in acoustic signal generation the sound collection signals of the channel corresponding to the target microphone 116 from which the state change is detected.

For example, in the case in which the sound collection region 1216 of the microphone 116 before the change does not overlap the sound collection region 1316 of the microphone 116 after the change, the channel control unit 410 can set the parameters such that the sound collection signals of the channel corresponding to the microphone 116 are not used in acoustic signal generation. Specifically, the channel control unit 410 can set to zero the combining ratio of the channel corresponding to the microphone 116 in the combining of the sound collection signals of the plurality of channels. Specifically, the parameters set by the channel control unit 410 indicate whether to use in acoustic signal generation the sound collection signals of the channel corresponding to the target microphone 116 from which the state change is detected. Alternatively, whether to use sound collection signals of sounds collected by the microphone can be determined based on not only the determination as to whether the sound collection region before the change and the sound collection region after the change overlap each other but also the size of the overlapping region, the relationship between the direction of the microphone before the change and the direction of the microphone after the change, etc.

In a case in which the sound collection region of the microphone 116 is changed significantly after the change with respect to the sound collection region before the change, collected sounds are also significantly different. Thus, acoustic signals are generated from sound collection signals of the other microphone without using the sound collection signals of the microphone 116 to generate acoustic signals from which appropriate sounds are reproducible.

[Switch Between Front Microphone and Rear Microphone]

Figure 14:
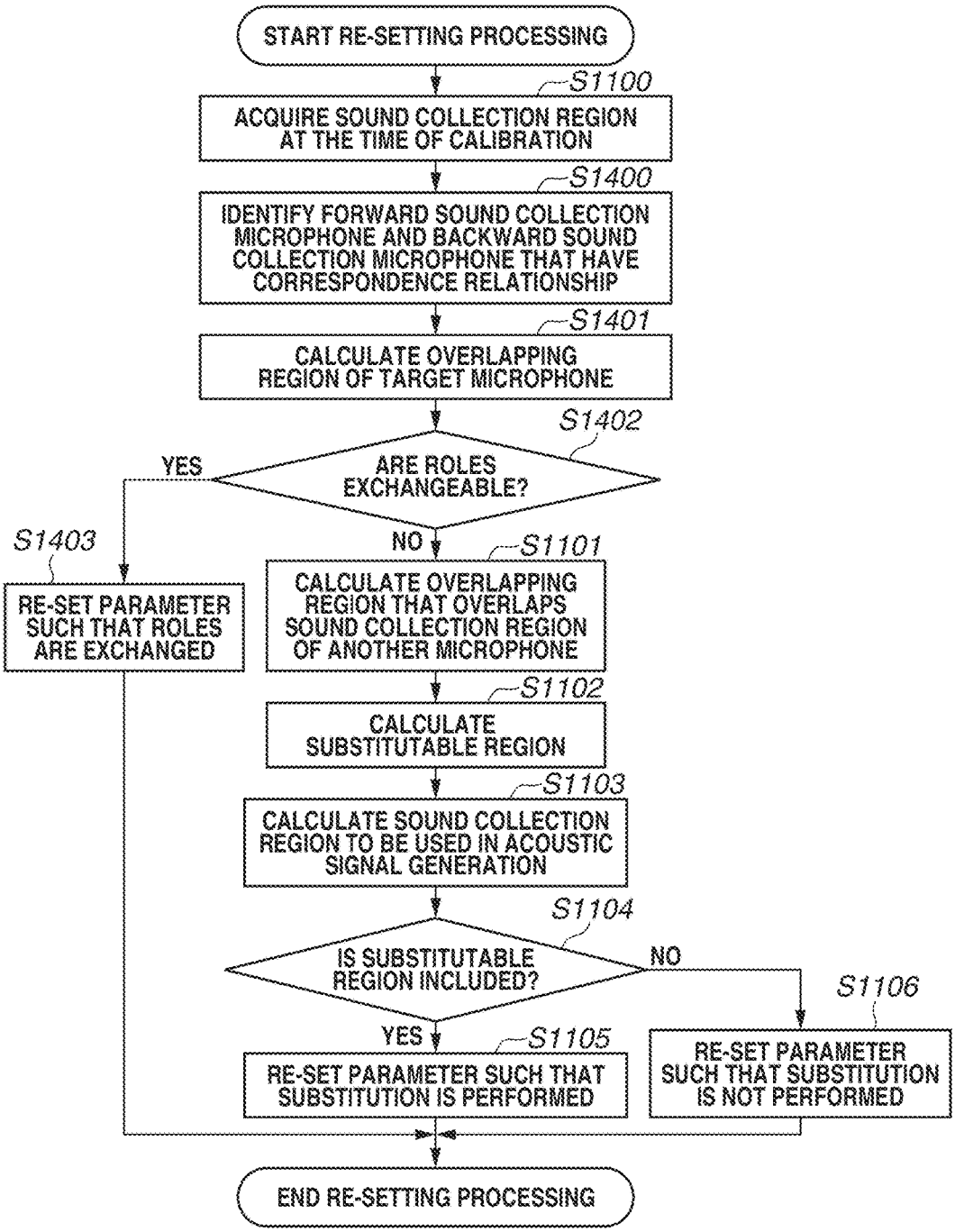
FIG. 14 is a flowchart illustrating a parameter setting process performed by the processing device.

Next, operations performed in the case of switching between the forward sound collection microphone 303 and the backward sound collection microphone 304 in response to a state change in the microphone will be described below with reference to FIG. 14. The process in FIG. 14 is a modified example of the process in FIG. 11 which is performed in step S75 in FIG. 7, and steps S1400 to S1403 are inserted between steps S1100 and S1101 in FIG. 11. In the following description, differences from the process in FIG. 11 will be described.

In step S1400, the channel control unit 410 identifies, based on the microphone information 450 stored in the accumulation unit 407, the forward sound collection microphone 303 and the backward sound collection microphone 304 having a correspondence relationship. Specifically, the forward sound collection microphone 303 and the backward sound collection microphone 304 which are mounted on the same microphone device and have directivities in different directions are identified.

In step S1401, the channel control unit 410 calculates the overlapping region of the sound collection region of the forward sound collection microphone 303 before the change and the sound collection region of the backward sound collection microphone 304 after the change in the target microphone from which the state change is detected. In step S1402, the channel control unit 410 determines whether the roles of the forward sound collection microphone 303 and the backward sound collection microphone 304 are exchangeable. For example, if the size of the overlapping region calculated in step S1401 is greater than or equal to a threshold value, the channel control unit 410 determines that the roles are exchangeable (YES in step S1402), and the processing proceeds to step S1403. On the other hand, if the channel control unit 410 determines that the roles are not exchangeable (NO in step S1402), the processing proceeds to step S1101, and similar processing to that described above with reference to FIG. 11 is performed thereafter. Alternatively, the channel control unit 410 can determine whether the roles are exchangeable based on the orientations of the forward sound collection microphone 303 and the backward sound collection microphone 304 before the state change without using the result of identification of the sound collection region.

In step S1403, the channel control unit 410 exchanges the roles of the forward sound collection microphone 303 and the backward sound collection microphone 304 of the target microphone. Specifically, the channel control unit 410 re-sets the parameters for use in acoustic signal generation such that at least part of the sounds of the region from which the forward sound collection microphone 303 collects sounds before the state change is substituted by the sounds collected by the backward sound collection microphone 304. Similarly, the channel control unit 410 re-sets the parameters for use in acoustic signal generation such that at least part of the sounds of the region from which the backward sound collection microphone 304 collects sounds before the state change is substituted by the sounds collected by the forward sound collection microphone 303. Then, the process in FIG. 14 is ended.

[Example of Exchange of Microphones]

Figure 15:
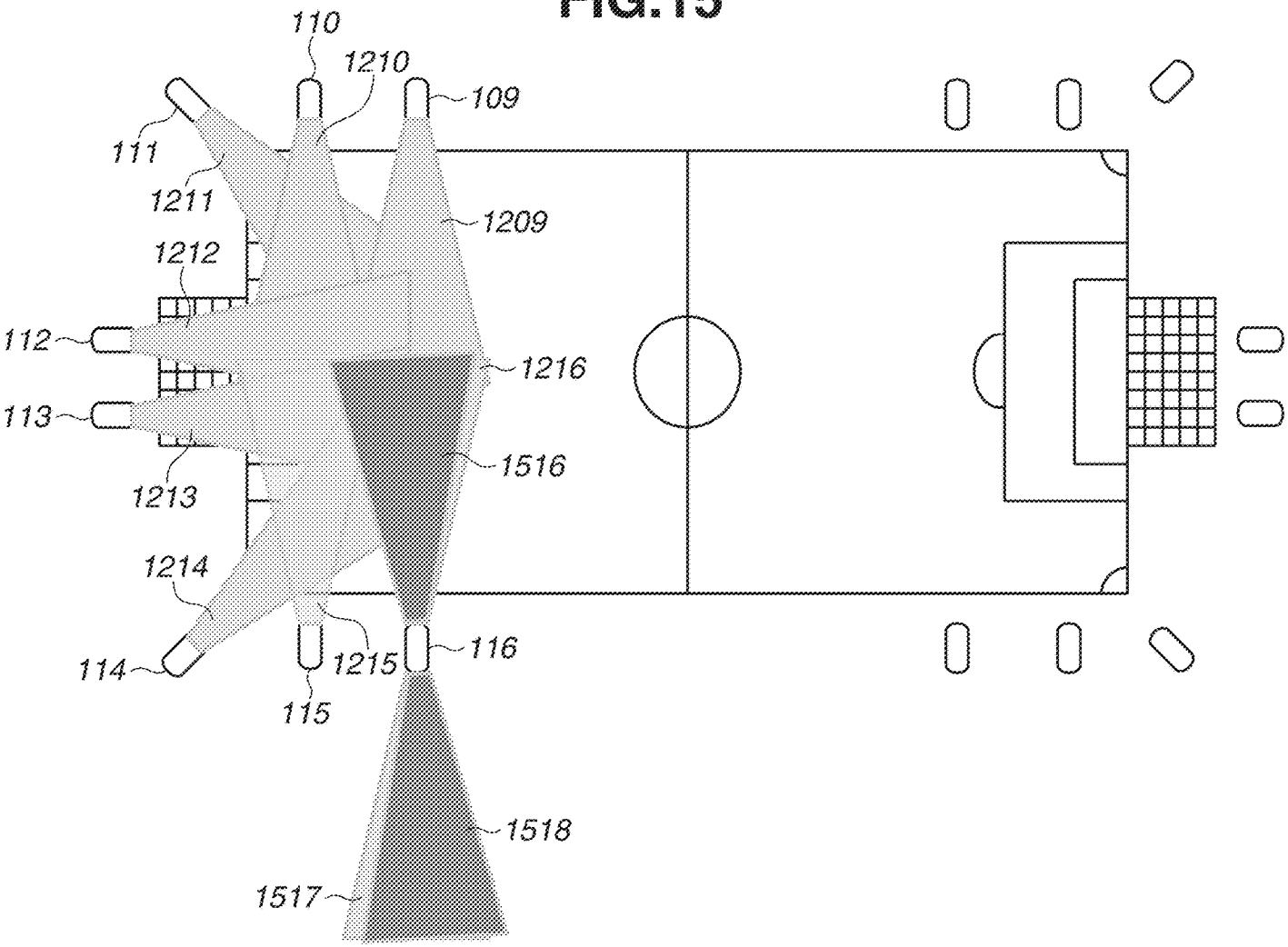
FIG. 15 illustrates an example of a case of exchanging a role of the microphone.

An example in which the roles of the microphones are exchanged will be described below with reference to FIG. 15. FIG. 15 illustrates the state in which the orientation of the microphone 116 is changed to the opposite orientation. The sound collection region of the forward sound collection microphone 303 of the microphone 116 is changed from the sound collection region 1216 to a sound collection region 1518, whereas the sound collection region of the backward sound collection microphone 304 is changed from a sound collection region 1517 to a sound collection region 1516.

The sound collection regions 1216 and 1516 have a large overlapping portion. Similarly, the sound collection regions 1517 and 1518 also have a large overlapping portion. Thus, the processing device 130 exchanges the roles of the forward sound collection microphone 303 and the backward sound collection microphone 304 by re-setting the parameters for the combining of sound collection signals. Consequently, the processing device 130 uses sounds collected by the backward sound collection microphone 304 to generate sounds of the field 100, whereas the processing device 130 uses sounds collected by the forward sound collection microphone 303 to generate sounds of the audience.

While the case in which the roles of the forward sound collection microphone 303 and the backward sound collection microphone 304 are exchanged is described above, this is not a limiting case, and the roles of a plurality of microphones provided in different housings can be exchanged. For example, in a case in which the positions of the microphones 115 and 116 are switched, the roles of the microphones 115 and 116 can be exchanged. As described above, if a state change is detected in the plurality of microphones, the processing device 130 can determine the parameters based on whether the sound collection region of one of the microphones before the change overlaps the sound collection region of the other microphone after the change. This makes it possible to prevent a change in how the sounds reproduced using the generated acoustic signals are heard even in a case in which the positions and/or orientations of the plurality of microphones are switched.

[Acoustic Signal Generation According to Camera Path]

In the present exemplary embodiment, the processing device 130 performs acoustic signal generation based on the camera path information 454. Specifically, the processing device 130 acquires from the camera path information 454 stored in the accumulation unit 407 viewpoint information indicating a viewpoint (image capturing position and image capturing direction) corresponding to video images reproduced together with the acoustic signals generated by the acoustic generation unit 409. Then, the processing device 130 determines the parameters for use in acoustic signal generation, based on the acquired viewpoint information, the state of the microphones described above, etc. This enables the processing device 130 to generate acoustic signals appropriate for the video images, such as acoustic signals that follow the image capturing position, in a case in which, for example, images are captured by switching a plurality of cameras installed in an athletic field or images are captured while moving a camera. Then, the generated acoustic signals are reproduced in an appropriate reproduction environment to reproduce, for example, how the sounds are heard in the image capturing position.

Figure 16:
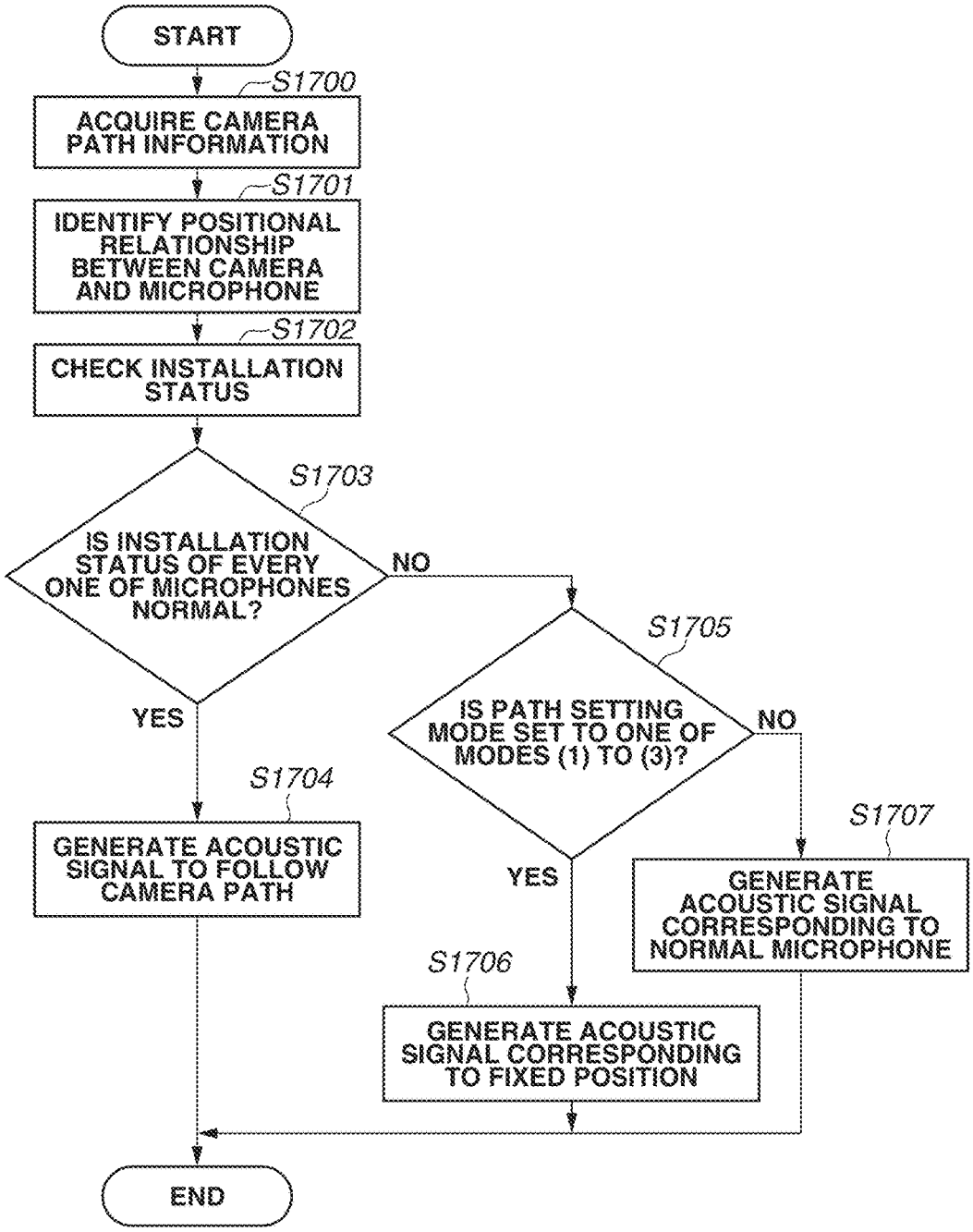
FIG. 16 is a flowchart illustrating a process of generating an acoustic signal corresponding to a camera path which is performed by the processing device.

The following describes operations of the processing device 130 for generating acoustic signals corresponding to a camera path (movement path of viewpoint of camera) with reference to FIG. 16. The process in FIG. 16 is executed in the acoustic signal generation processing in step S76 in FIG. 7. In step S1700, the acoustic generation unit 409 acquires the viewpoint information from the camera path information 454. The viewpoint information acquired herein, for example, specifies a switch order and switch time of the cameras used and indicates the movement path of the viewpoint.

In step S1701, the acoustic generation unit 409 identifies the positional relationship between the cameras and the microphones based on the microphone information 450, etc. The identification of the positional relationship can be performed at the time of calibration in step S501. In step S1702, the processing device 130 checks the installation status of each microphone. For example, if the amount of a detected state change in a microphone is greater than or equal to a threshold value, it is determined that the installation status of the microphone is abnormal. On the other hand, if no state change is detected or if the amount of a detected change is less than the threshold value, it is determined that the installation status of the microphone is normal.

In step S1703, the processing device 130 identifies the microphones that are needed to generate acoustic signals corresponding to video images, based on the viewpoint information acquired in step S1700 and the positional relationship between the cameras and the microphones that is identified in step S1701. Then, the processing device 130 determines whether the installation status of every one of the identified microphones is normal. If the processing device 130 determines that the installation status of every one of the identified microphones is normal (YES in step S1703), the processing proceeds to step S1704. On the other hand, if the installation status of at least one of the microphones is abnormal (NO in step S1703), the processing proceeds to step S1705.

In step S1704, the processing device 130 determines the parameters such that acoustic signals that can reproduce sounds of a position following the camera path are generated, and combines the sound collection signals.

In step S1705, the processing device 130 checks a path setting mode which is set according to a user operation. The path setting mode includes the following five modes.

(1) A mode in which an acoustic signal corresponding to a position (start point position) of a start of the camera path is generated.

(2) A mode in which an acoustic signal corresponding to a position (end point position) of an end of the camera path is generated.

(3) A mode in which an acoustic signal corresponding to an arbitrary fixed position designated by the user on the camera path is generated.

(4) A mode in which an acoustic signal corresponding to a position near a microphone of a normal installation status is generated.

(5) A mode in which an acoustic signal of a position following the camera path only from the start point position of the camera path up to a position near the front of the microphone of abnormal installation status is generated.

If the set mode is one of the modes (1), (2), and (3) (YES in step S1705), the processing proceeds to step S1706. On the other hand, if the mode is the mode (4) or (5) (NO in step S1705), the processing proceeds to step S1707. In steps S1706 and S1707, the processing device 130 sets the parameters to generate an acoustic signal corresponding to the mode and combines the sound collection signals.

As described above, the processing device 130 determines the parameters for use in acoustic signal generation such that the acoustic generation unit 409 generates acoustic signals corresponding to the start point position of the camera path, the end point position of the camera path, a position determined according to the target microphone from which a state change is detected, etc. This makes it possible to generate acoustic signals from which highly-realistic sounds that match video images are reproducible.

The video images to be reproduced together with the acoustic signals generated by the acoustic generation unit 409 are not limited to video images captured by the cameras. For example, there is a technique in which video images captured from a plurality of directions by a plurality of cameras are combined to generate virtual viewpoint video images corresponding to a virtual viewpoint in which no camera exists. This technique can be used to generate video images corresponding to an arbitrary viewpoint designated by a user and reproduce the generated video images together with the acoustic signals. In this case, information about the user-designated viewpoint is used as the camera path information 454. Then, the processing device 130 generates acoustic signals corresponding to the camera path which is the movement path of the user-designated viewpoint, i.e., acoustic signals for reproducing how the sounds are heard in the position of the designated viewpoint. The virtual viewpoint is not limited to the user-designated virtual viewpoint and can be determined automatically by a system that generates the video images.

[User Interface]

Figure 17:
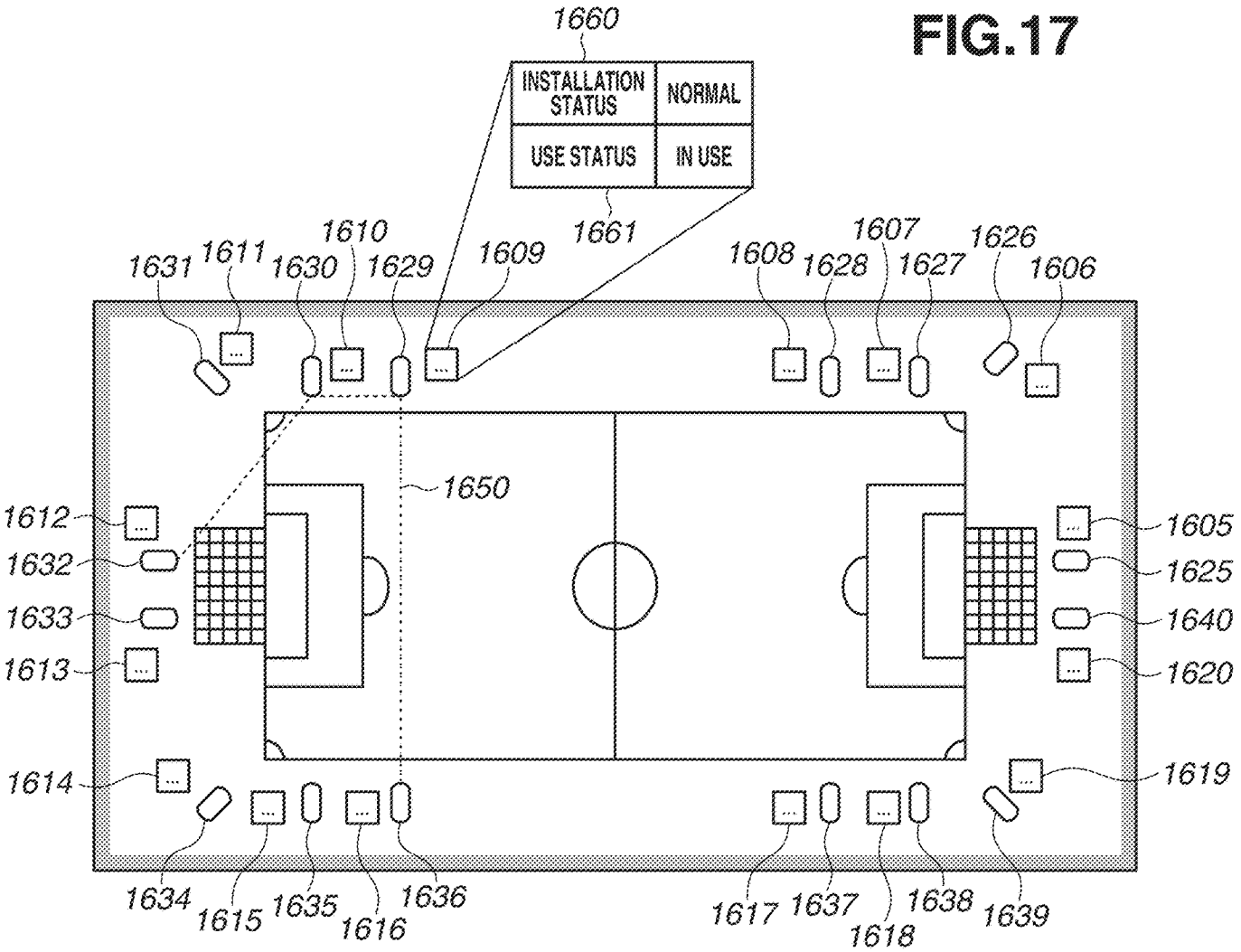
FIG. 17 illustrates a user interface of the processing device.

While FIG. 16 illustrates a case in which acoustic signals corresponding to the position according to the camera path are generated, this is not a limiting case, and the processing device 130 can generate acoustic signals corresponding to a position according to a user designation. An example of a user interface for use in this case will be described below with reference to FIG. 17. In the present exemplary embodiment, the image illustrated in FIG. 17 is displayed on the touch panel of the processing device 130.

State displays 1605 to 1620 indicate the states of the microphones 105 to 120. The state display of each microphone includes an installation status 1660 and a use status 1661. As to the installation status 1660, "normal" or "abnormal" is displayed according to a result of detection of a state change in the microphone described above. As to the use status 1661, "in use" is displayed if the microphone is used in acoustic signal generation according to a user designation, whereas "not in use" is displayed if the microphone is not used.

If the user touches microphone icons 1625 to 1640, the processing device 130 switches the state displays 1605 to 1620 to hide the state displays 1605 to 1620. Further, if the user performs a slide operation on the touch panel while touching the touch panel, the processing device 130 sets a microphone path according to the operation. For example, if the user performs a slide operation to designate microphone icons 1632, 1630, 1629, and 1636 in this order, a microphone path 1650 is set.

If the microphone path 1650 is set, the processing device 130 generates acoustic signals corresponding to a position that moves on the microphone path 1650. While the microphone path 1650 is set via the microphones in FIG. 17, the microphone path is not limited to the microphone path 1650, and a position where there is no microphone can be also designated.

[Automatic Correction of Microphone State]

As described above, if a state change in the microphone is detected, the processing device 130 re-sets the parameters for use in acoustic signal generation to prevent a change in how the reproduced sounds are heard. However, acoustic signals from which more appropriate sounds are reproducible can be generated if the microphone is returned to the state before the change. The following describes a case in which the acoustic processing system 10 performs control to correct the state of the target microphone from which a state change is detected.

Figure 18:
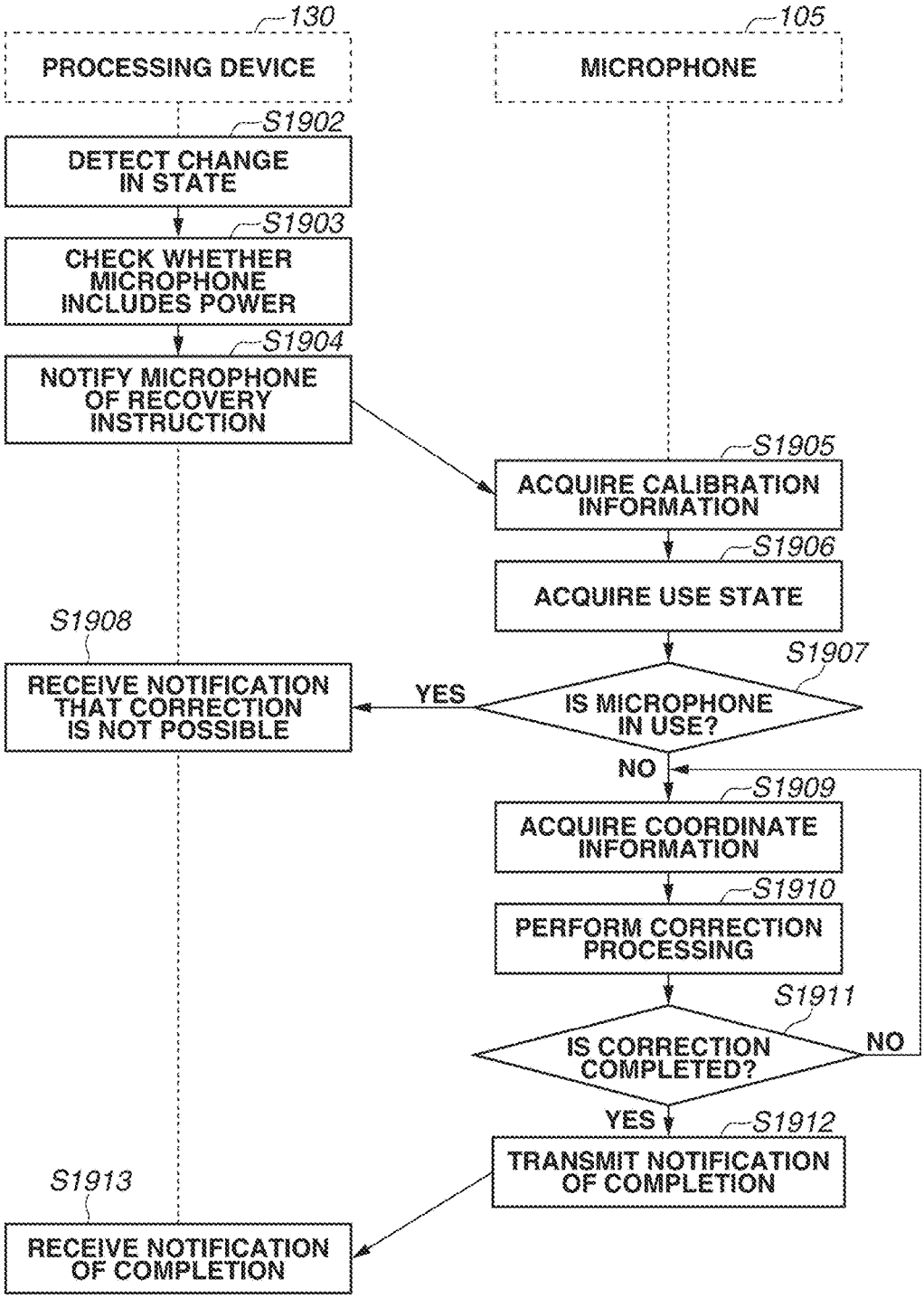
FIG. 18 is a flowchart illustrating a microphone state correction process performed by the acoustic processing system.

FIG. 18 illustrates a flow of operations of correcting a microphone state. In FIG. 18, a state change in the microphone 105 is to be detected. The process illustrated on the left of FIG. 18 is executed by the processing device 130, whereas the process illustrated on the right is executed by the microphone 105.

In step S1902, the processing device 130 detects a state change in the microphone 105. In step S1903, the processing device 130 refers to the microphone information 450 and checks whether the microphone 105 includes a power source such as a motor. In the present exemplary embodiment, a case in which the microphone 105 includes a power source will be described. In a case in which the microphone 105 does not include a power source, the process in FIG. 18 is ended, and the parameter re-setting is used as described above.

In step S1904, the processing device 130 notifies the microphone 105 of a recovery instruction. In step S1905, the microphone 105 acquires calibration information at the time of installation. Specifically, information corresponding to the microphone 105 from the calibration result 451 stored the accumulation unit 407 is received from the channel control unit 410 via the MADI interface 405. In step S1906, the microphone 105 acquires use state information indicating as to whether the sound collection signals of sounds collected by the microphone 105 are used in the acoustic signal generation at this time point. A method for acquiring use state information is similar to the method for acquiring calibration information in step S1905.

In step S1907, the microphone 105 determines whether the microphone 105 is in use based on the use state information. If the microphone 105 determines that the microphone 105 is in use (YES in step S1907), the microphone 105 notifies the processing device 130 that it is not possible to correct the state of the microphone 105, and the processing proceeds to step S1908. On the other hand, if the microphone 105 determines that the microphone 105 is not in use (NO in step S1907), the processing proceeds to step S1909. In step S1908, the processing device 130 receives, from the microphone 105, the notification that correction is not possible. Then, the process in FIG. 18 is ended. In a case in which the microphone 105 cannot be corrected, the processing device 130 can perform control not to use the sound collection signals of sounds collected by the microphone 105.

In step S1909, the microphone 105 acquires coordinate information using the forward position sensor 305 and the backward position sensor 306. In step S1910, the microphone 105 calculates a correction direction and a correction amount that are needed to return to the state before the change, based on the calibration information acquired in step S1905 and the coordinate information acquired in step S1909. Then, the microphone 105 corrects the state using the power source such as a motor.

In step S1911, the microphone 105 determines whether the correction is properly completed. As a result of the determination, if re-adjustment is needed (NO in step S1911), the processing returns to step S1909. On the other hand, if the microphone 105 determines that the correction is completed (YES in step S1911), the processing proceeds to step S1912. In step S1912, the microphone 105 notifies the processing device 130 that the correction is completed. In step S1913, the processing device 130 receives the notification that the correction is completed, and the process in FIG. 18 is ended.

Figure 19:
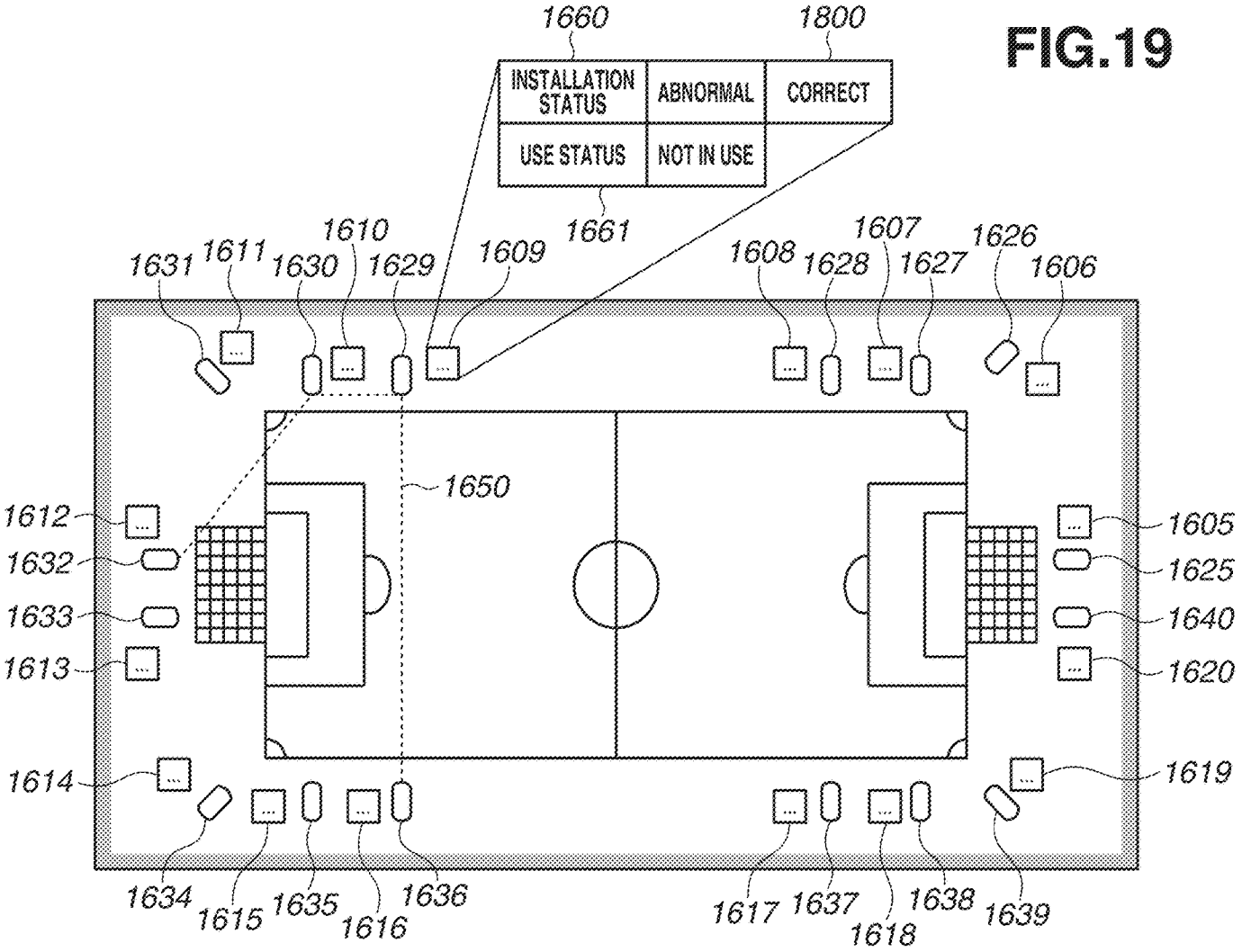
FIG. 19 illustrates a user interface of the processing device.

FIG. 19 illustrates an example of a user interface in a case in which the acoustic processing system 10 includes the function of correcting the state of the microphone. FIG. 19 is different from FIG. 17 in that a button (correction button 1800) for giving an instruction to correct the state is displayed in addition to the installation status 1660 and the use status 1661 in the state display 1609. If the correction button 1800 is touched by the user, step S1904 and subsequent steps in FIG. 18 are executed.

As described above, the acoustic processing system 10 detects a state change in the microphone, and if the microphone includes a power source required to perform correction, the state is automatically corrected. This makes it possible to recover the acoustic processing system to the state in which acoustic signals from which appropriate sounds are reproducible are generated while reducing the time and work of correction by the user.

[Transmission/Reception Interface]

In the present exemplary embodiment, the case in which the MADI interface is used in the communication between the preamplifiers and the communication between the preamplifiers and the recorders is mainly described. Use of the MADI interface makes it possible to transmit the sound collection signals of sounds collected by the microphones together with metadata indicating the sound collection region, etc. so that an increase in wiring is prevented.

Figure 20:
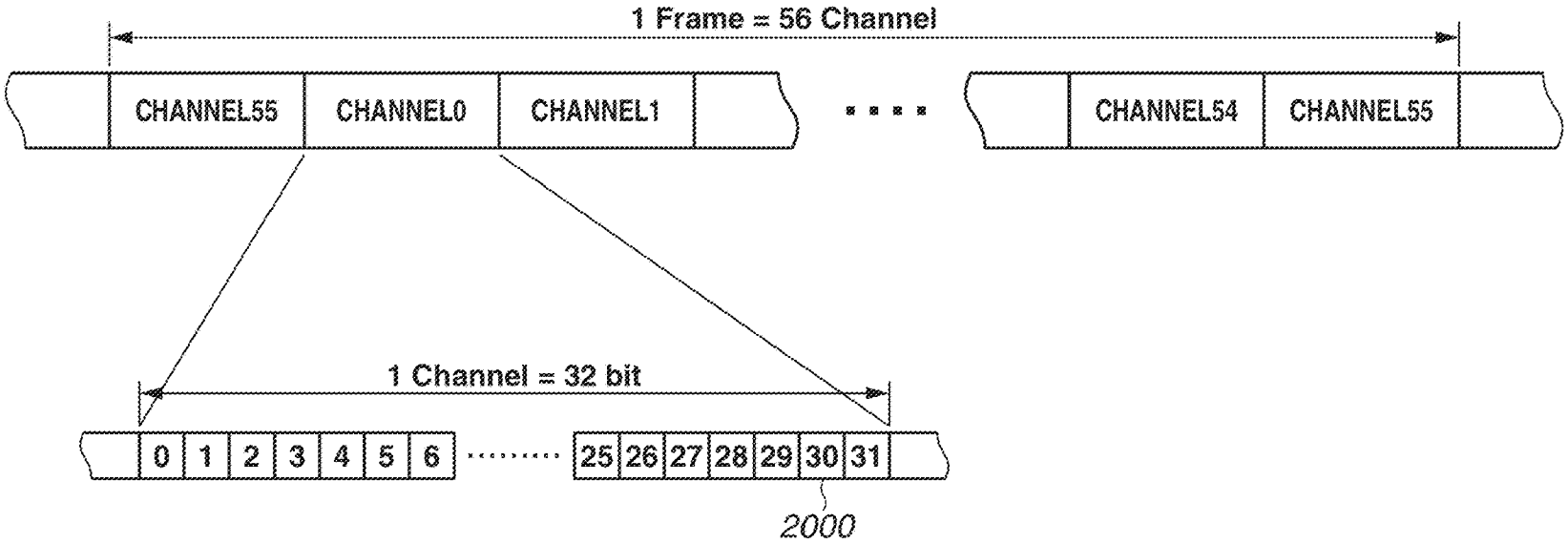
FIG. 20 illustrates a configuration of data transmitted in the acoustic processing system.

FIG. 20 illustrates an example of data transmitted by the MADI interface. One frame which is a unit of transmission is constituted of 56 channels, and each channel stores the sound collection signals of sounds collected by the microphone. Further, each channel includes an area where no sound collection signal is stored, e.g., status bit 2000. Use of the plurality of channels and the status bits 2000 included in the plurality of frames makes it possible to transmit, to the preamplifiers, the metadata output from the preamplifiers and the control information transmitted from the channel control unit 410. Alternatively, the acoustic processing system 10 can transmit data using an interface different from the MADI interface.

As described above, the processing device 130 according to the present exemplary embodiment detects a state change in the microphone. Further, the processing device 130 determines the parameters for use in acoustic signal generation by the acoustic generation unit 409 that generates acoustic signals based on the sound collection signals of one or more of the plurality of channels based on the sounds collected by the plurality of microphones. In the parameter determination, if a state change is detected in at least any of the plurality of microphones, the processing device 130 determines the parameters based on the states of the plurality of microphones after the change. This configuration makes it possible to prevent a change in how the sounds reproduced using the acoustic signals generated based on the sounds collected by the plurality of microphones are heard in a case in which there is a state change in the microphones.

In the present exemplary embodiment, the processing device 130 detects a change in at least one of the installation position and installation orientation of a microphone as a state change in the microphone. Then, the state change in the microphone is detected based on the information acquired by the plurality of sensors. Further, the case in which the processing device 130 determines the parameters for use in acoustic signal generation based on the installation positions and installation orientations of the plurality of microphones before the change and the installation positions and installation orientations of the plurality of microphones after the change is mainly described.

The determination is not limited to the above-described determination and, for example, the processing device 130 can determine the combining parameter based only on the result of detection of the position of the microphone without detecting the orientation of the microphone. Specifically, the parameters can be determined such that sound collection signals of sounds collected by the microphone from which a change in the position is detected in an amount greater than or equal to the threshold value are not used in acoustic signal generation. In a case in which only a change in the position of the microphone is detected, the number of sensors provided to the microphone can be one. Similarly, the processing device 130 can determine the combining parameter based only on the result of detection of the direction of the microphone without detecting the position of the microphone.

Further, for example, the processing device 130 can detect as a state change in the microphone an instance that the power supply of the installed microphone is turned off or an instance that the microphone malfunctions. Further, for example, the processing device 130 can compare the sound collection signals of the sounds collected by the plurality of microphones, and if there is a microphone that outputs sound collection signals significantly different in characteristics from those of the other microphones, the processing device 130 can determine that there is a state change in the microphone.

Further, while the case in which the acoustic processing system 10 performs acoustic signal generation concurrently with sound collection is mainly described in the present exemplary embodiment, this is not a limiting case and, for example, sound collection signals of sounds collected during a game in an athletic field can be accumulated to generate acoustic signals after the game. In this case, the acoustic processing system 10 records the timing at which the state change in the microphone is detected during the sound collection. Then, the acoustic processing system 10 can use the recorded information at the time of generating acoustic signals to determine the combining parameter corresponding to each time interval of the acoustic signals.

Embodiments are also realizable by a process in which a program that realizes one or more functions of the above-described exemplary embodiment is supplied to a system or apparatus via a network or storage medium, and one or more processors of a computer of the system or apparatus read and execute the program. Further, embodiments are also realizable by a circuit (e.g., ASIC) that realizes one or more functions. Further, the program can be recorded in a computer-readable recording medium and provided.

The above-described exemplary embodiment is capable of generating acoustic signals from which appropriate sounds are reproducible based on sounds collected by a plurality of microphones even in a case in which there is a state change in the microphones.

Other Embodiments

Embodiment(s) can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the above has been described with reference to exemplary embodiments, it is to be understood that the description is not limited to the disclosed exemplary embodiments. The scope of the following claims is to be accorded the broadest interpretation so as to encompass all such modifications and equivalent structures and functions.

This application claims the benefit of Japanese Patent Application No. 2017-166105, filed Aug. 30, 2017, which is hereby incorporated by reference herein in its entirety.

What is claimed is:

1. An audio processing apparatus comprising:

one or more hardware processors; and one or more memories which store instructions executable by the one or more hardware processors to cause the audio processing apparatus to perform at least:

detecting a change in a state of a microphone;

obtaining viewpoint information indicating a position of a viewpoint corresponding to an image; and determining a parameter to be used for generating an audio signal according to the position of the viewpoint, wherein the audio signal is generated based on one or more of a plurality of channels of collected sound signals acquired by sound collection with a plurality of microphones, and wherein in response to detection of a change in a state of at least one of the plurality of microphones in the detecting, the parameter is determined based on states of the plurality of microphones after the change and the obtained viewpoint information.

2. The audio processing apparatus according to claim 1, wherein in response to the detection of the change in the state of at least one of the plurality of microphones in the detecting, the parameter is determined based on states of the plurality of microphones before the change and the states of the plurality of microphones after the change.

3. The audio processing apparatus according to claim 1, wherein, in the detecting, a change in at least one of a position and an orientation of the microphone is detected as the change in the state, and wherein the parameter is determined based on positions and orientations of the plurality of microphones.

4. The audio processing apparatus according to claim 1, wherein the determined parameter includes a parameter associated with a combining ratio of the plurality of channels of collected sound signals for generating the audio signal.

5. The audio processing apparatus according to claim 1, wherein the determined parameter specifies whether to use, in generating the audio signal, a collected sound signal of a channel that corresponds to a microphone of which the change in the state is detected.

6. The audio processing apparatus according to claim 5, wherein in a case where a sound collection region of the microphone before the change does not overlap a sound collection region of the microphone after the change, the parameter is determined such that the collected sound signal of the channel corresponding to the microphone is not used in generating the audio signal.

7. The audio processing apparatus according to claim 6, wherein the sound collection region of the microphone is a region to be determined based on a position, orientation, and directivity of the microphone.

8. The audio processing apparatus according to claim 1, wherein in a case where a change in states of a first microphone and a second microphone among the plurality of microphones is detected the parameter is determined based on whether a sound collection region of the first microphone before the change overlaps a sound collection region of the second microphone after the change.

9. The audio processing apparatus according to claim 8, wherein the first microphone and the second microphone are mounted on a same device and have directivity in a different direction from each other.

10. The audio processing apparatus according to claim 1, wherein the instructions further cause the audio processing apparatus to generate the audio signal according to the determined parameter.

11. The audio processing apparatus according to claim 1, wherein the instructions further cause the audio processing apparatus to output the determined parameter to an apparatus configured to generate the audio signal.

12. The audio processing apparatus according to claim 1, wherein the viewpoint information indicates the position of the viewpoint corresponding to a virtual viewpoint image to be played together with the audio signal, and wherein the virtual viewpoint image is generated based on a plurality of captured images obtained by a plurality of image capturing apparatuses.

13. The audio processing apparatus according to claim 12, wherein the parameter is determined such that an audio signal corresponds to one of a start point position of a movement path of the viewpoint indicated by the viewpoint information, an end point position of the movement path, and a position determined according to a microphone of which the change in the state is detected.

14. The audio processing apparatus according to claim 1, wherein the instructions further cause the audio processing apparatus to perform control to correct a state of a microphone of which the change in the state is detected.

15. The audio processing apparatus according to claim 1, wherein the change in the state of the microphone is detected based on information acquired by sensors provided to the plurality of microphones.

16. The audio processing apparatus according to claim 1, wherein each of a plurality of signal processing devices which are daisy-chain connected performs signal processing on a sound signal acquired with a corresponding microphone among the plurality of microphones to acquire a channel of a collected sound signal.

17. An audio processing method comprising:

detecting a change in a state of a microphone;

obtaining viewpoint information indicating a position of a viewpoint corresponding to an image; and determining a parameter to be used for generating an audio signal according to the position of the viewpoint, wherein the audio signal is generated based on one or more of a plurality of channels of collected sound signals acquired by sound collection with a plurality of microphones, and wherein in response to detection of a change in a state of at least one of the plurality of microphones in the detecting, the parameter is determined based on states of the plurality of microphones after the change and the obtained viewpoint information.

18. The method according to claim 17, wherein in response to the detection of the change in the state of at least one of the plurality of microphones in the detecting, the parameter is determined based on states of the plurality of microphones before the change and the states of the plurality of microphones after the change.

19. The method according to claim 17, wherein in the detecting, a change in at least one of a position and an orientation of the microphone is detected as the change in the state, and wherein the parameter is determined based on positions and orientations of the plurality of microphones.

20. A non-transitory storage medium storing a program that causes a computer to execute an audio processing method comprising:

detecting a change in a state of a microphone;

obtaining viewpoint information indicating a position of a viewpoint corresponding to an image; and determining a parameter to be used for generating an audio signal according to the position of the viewpoint, wherein, the audio signal is generated based on one or more of a plurality of channels of collected sound signals acquired by sound collection with a plurality of microphones, and wherein in in response to detection of a change in a state of at least one of the plurality of microphones is in the detecting, the parameter is determined based on states of the plurality of microphones after the change and the obtained viewpoint.

* * * * *